US006624798B1

(12) United States Patent
Aoki et al.

(10) Patent No.: US 6,624,798 B1
(45) **Date of Patent: *Sep. 23, 2003**

(54) DISPLAY APPARATUS WITH FLAT DISPLAY PANEL

(75) Inventors: Masami Aoki; Toyoshi Kawada; Haruo Koizumi, all of Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/816,684

(22) Filed: Mar. 13, 1997

(30) Foreign Application Priority Data

Oct. 15, 1996 (JP) ..... 8-271946

(51) Int. Cl.[7] ..... G09G 3/28
(52) U.S. Cl. ..... 345/60; 345/55; 345/87
(58) Field of Search ..... 345/60, 67, 68, 345/75, 76, 94, 95, 97, 98, 100, 208, 209, 69, 70, 79, 96; 315/169.1, 169.4, 169.3

(56) References Cited

U.S. PATENT DOCUMENTS

| | | | | |
|---|---|---|---|---|
| 4,316,123 A | | 2/1982 | Kleen et al. | 315/169.4 |
| 5,142,200 A | | 8/1992 | Yamamoto et al. | 315/169.4 |
| 5,483,252 A | * | 1/1996 | Shigeta | 345/67 |
| 5,541,618 A | | 7/1996 | Shinoda | 345/60 |
| 5,583,527 A | * | 12/1996 | Fujisaki et al. | 345/55 |
| 5,670,974 A | * | 9/1997 | Ohba et al. | 345/60 |
| 5,790,092 A | * | 8/1998 | Moriyama | 345/96 |
| 5,835,072 A | * | 11/1998 | Kanazawa | 345/60 |
| 5,886,679 A | * | 3/1999 | Matsuda et al. | 345/96 |

FOREIGN PATENT DOCUMENTS

| | | |
|---|---|---|
| JP | 7-64508 | 3/1995 |
| JP | 08-305319 | 11/1996 |

OTHER PUBLICATIONS

IBM Technical Disclosure Bulletin, vol. 17, No. 1, Jun. 1974, New York, U.S., p. 107.

* cited by examiner

*Primary Examiner*—Richard Hjerpe
*Assistant Examiner*—Francis Nguyen
(74) *Attorney, Agent, or Firm*—Staas & Halsey LLP

(57) ABSTRACT

A plasma-display-panel display apparatus includes a flat display panel having a plurality of address electrodes and a plurality of scanning electrodes extending transversely to the address electrodes and disposed in confronting relation to the address electrodes with a discharge space defined therebetween. A scanning electrode driver successively supplies scanning pulses to the scanning electrodes with scanning timing, and an address driver supplies address pulses according to display data to the address electrodes in synchronism with the scanning timing. The address electrodes include first and second address electrodes disposed adjacent to each other. The address pulse applied to the first address electrode rises and the address pulse applied to the second address electrode falls with a predetermined time difference therebetween.

28 Claims, 18 Drawing Sheets

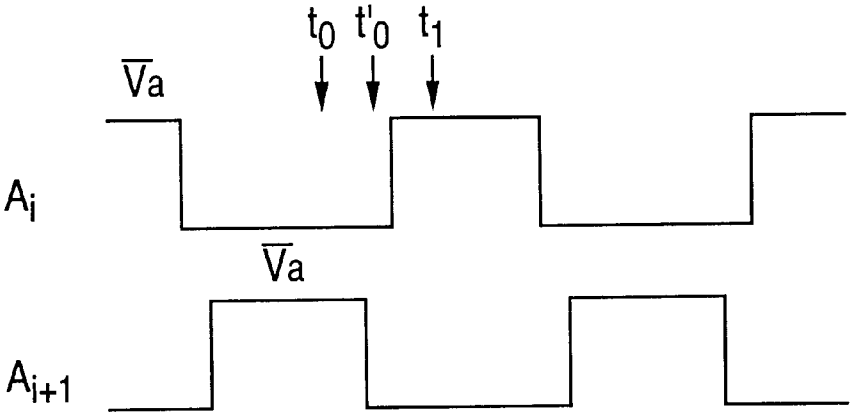
FIG. 13
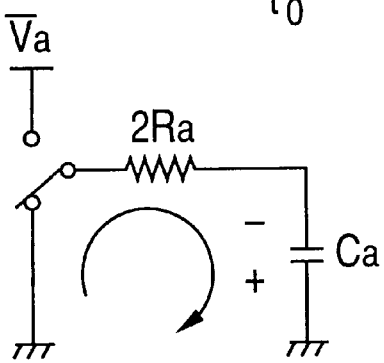
FIG. 14A
FIG. 14B
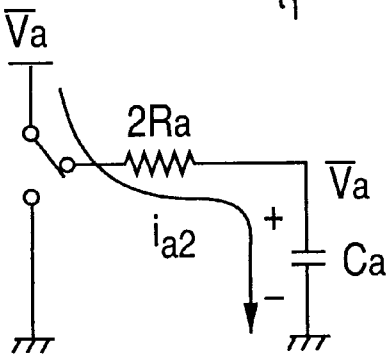
FIG. 14C

WAVEFORM OF DRIVE PULSE EXAMPLE 1

WAVEFORM OF DRIVE PULSE EXAMPLE 2

WAVEFORM OF DRIVE PULSE EXAMPLE 3

WAVEFORM OF DRIVE PULSE EXAMPLE 4

WAVEFORM OF DRIVE PULSE EXAMPLE 5

WAVEFORM OF DRIVE PULSE EXAMPLE 6

DISPLAY APPARATUS WITH FLAT DISPLAY PANEL

BACKGROUND OF THE INVENTION

1. Field of the Invention

The present invention relates to a display apparatus having a flat display panel, and more particularly to an improvement in a driver circuit which requires reduced electric power consumption for energizing address lines or data bus lines in such a display apparatus.

2. Description of the Prior Art

Flat display panels include an AC-type plasma display panel (hereinafter referred to as a PDP), a DC-type PDP, a liquid crystal display panel (LCD), and an electroluminescent (EL) panel. A feature common to these display panels is that data signals representing display data are supplied from a driver circuit to a plurality of vertical address lines (or data bus lines) and a plurality of horizontal scanning lines are successively energized to display the display data at pixels positioned at the points of intersection between the address lines and the scanning lines.

When the scanning lines are successively energized downwardly and the data signals representing display data on the respective scanning lines are applied to the address lines, the address lines are charged from an L level to an H level and discharged from an H level to an L level. When an image which comprises a zigzag grid pattern of energized pixels (white pixels) and de-energized pixels (black pixels) is displayed, the address lines are charged and discharged between H and L levels each time a shift is made from one scanning line to another scanning line. With respect to any adjacent two of the address lines, one of the address line is charged and the other discharged.

The conventional driver circuit for energizing the address lines energizes the address lines to an H level or an L level during a period in which a scanning pulse is applied to a scanning line. In a next scanning period in which a scanning pulse is applied to a next scanning line, the driver circuit energizes the address lines simultaneously to an H level or an L level.

When the address lines are energized, a predetermined amount of electric power is consumed. The amount of electric power which is consumed needs to be as small as possible for PDPs that effect a plasma discharge for image display. LCDs for use in portable computers are desired to consume a reduced amount of electric power.

SUMMARY OF THE INVENTION

It is therefore an object of the present invention to provide a display apparatus having a flat display panel which consumes a reduced amount of electric power.

Another object of the present invention is to provide a display apparatus having a flat display panel which requires reduced electric power consumption for energizing address electrodes.

Still another object of the present invention is to provide a PDP display apparatus having a PDP which requires reduced electric power consumption for energizing address electrodes.

The inventor has noticed that when address lines are energized, capacitances between address electrodes and scanning electrodes confronting the address electrodes are charged and discharged, and also capacitances between adjacent address electrodes are charged and discharged, and has found a process of reducing the amount of electric power required to charge and discharge the capacitances between the adjacent address electrodes by improving the waveforms of drive pulses for the address electrodes.

For displaying a zigzag grid display pattern, described above, a capacitance between adjacent address lines is charged from one of the address lines and simultaneously discharged to the other address line, and hence the capacitance consumes a twofold amount of electric power. The consumed amount of electric power can be reduced to one half at most by forming a closed loop between the adjacent address lines through a power supply line (connected to a power supply or a ground). The principles of the process found by the inventor will be described later on.

The above objects of the present invention can be achieved by a display apparatus comprising a flat display panel having a plurality of address electrodes and a plurality of scanning electrodes extending transversely to the address electrodes and disposed in confronting relation to the address electrodes, a scanning electrode driver for successively supplying scanning pulses to the scanning electrodes with scanning timing, and an address driver for supplying address pulses according to display data to the address electrodes in synchronism with the scanning timing, wherein the address electrodes include first and second address electrodes disposed adjacent to each other, and the address pulse applied to the first address electrode rises and the address pulse applied to the second address electrode falls with a predetermined time difference therebetween.

The address driver may energize the address electrodes such that the address pulse applied to the second address electrode starts falling a predetermined time after the address pulse applied to the first address electrode starts rising.

Alternatively, the address driver may energize the address electrodes such that the address pulse applied to the first address electrode starts rising a predetermined time after the address pulse applied to the second address electrode starts falling.

The address driver may also energize the address electrodes such that the address pulse applied to the second address electrode starts falling after the address pulse applied to the first address electrode finishes rising.

Alternatively, the address driver may also energize the address electrodes such that the address pulse applied to the first address electrode starts rising after the address pulse applied to the second address electrode finishes falling.

The address driver may generate the predetermined time difference by energizing the address electrodes such that the address pulses applied to the first and second address electrodes rise at a gradient smaller than a gradient at which the address pulses applied to the first and second address electrodes fall.

Alternatively, the address driver may generate the predetermined time difference by energizing the address electrodes such that the address pulses applied to the first and second address electrodes rise at a gradient larger than a gradient at which the address pulses applied to the first and second address electrodes fall.

According to the present invention, the above objects can also be achieved by a PDP display apparatus comprising a flat display panel having a plurality of address electrodes and a plurality of scanning electrodes extending transversely to the address electrodes and disposed in confronting relation to the address electrodes with a discharge space defined therebetween, a scanning electrode driver for successively supplying scanning pulses to the scanning electrodes with scanning timing, and an address driver for supplying address pulses according to display data to the address electrodes in synchronism with the scanning timing, wherein the address electrodes include first and second address electrodes disposed adjacent to each other, and the address pulse applied to the first address electrode rises and the address pulse applied to the second address electrode falls with a predetermined time difference therebetween.

The address driver may be designed such that the predetermined time difference is effective to substantially reduce an amount of electric power consumed by the address driver to charge a capacitance between the first and second address electrodes.

The above and other objects, features, and advantages of the present invention will become apparent from the following description when taken in conjunction with the accompanying drawings which illustrate a preferred embodiment of the present invention by way of example.

BRIEF DESCRIPTION OF THE DRAWINGS

FIG. 13 is a diagram showing the waveforms of address pulses according to the principles of the present invention;

FIGS. 14(*a*), 14(*b*), and 14(*c*) are circuit diagrams of equivalent circuits corresponding to the equivalent circuit shown in FIG. 8;

DETAILED DESCRIPTION OF THE PREFERRED EMBODIMENT

Figure 1:
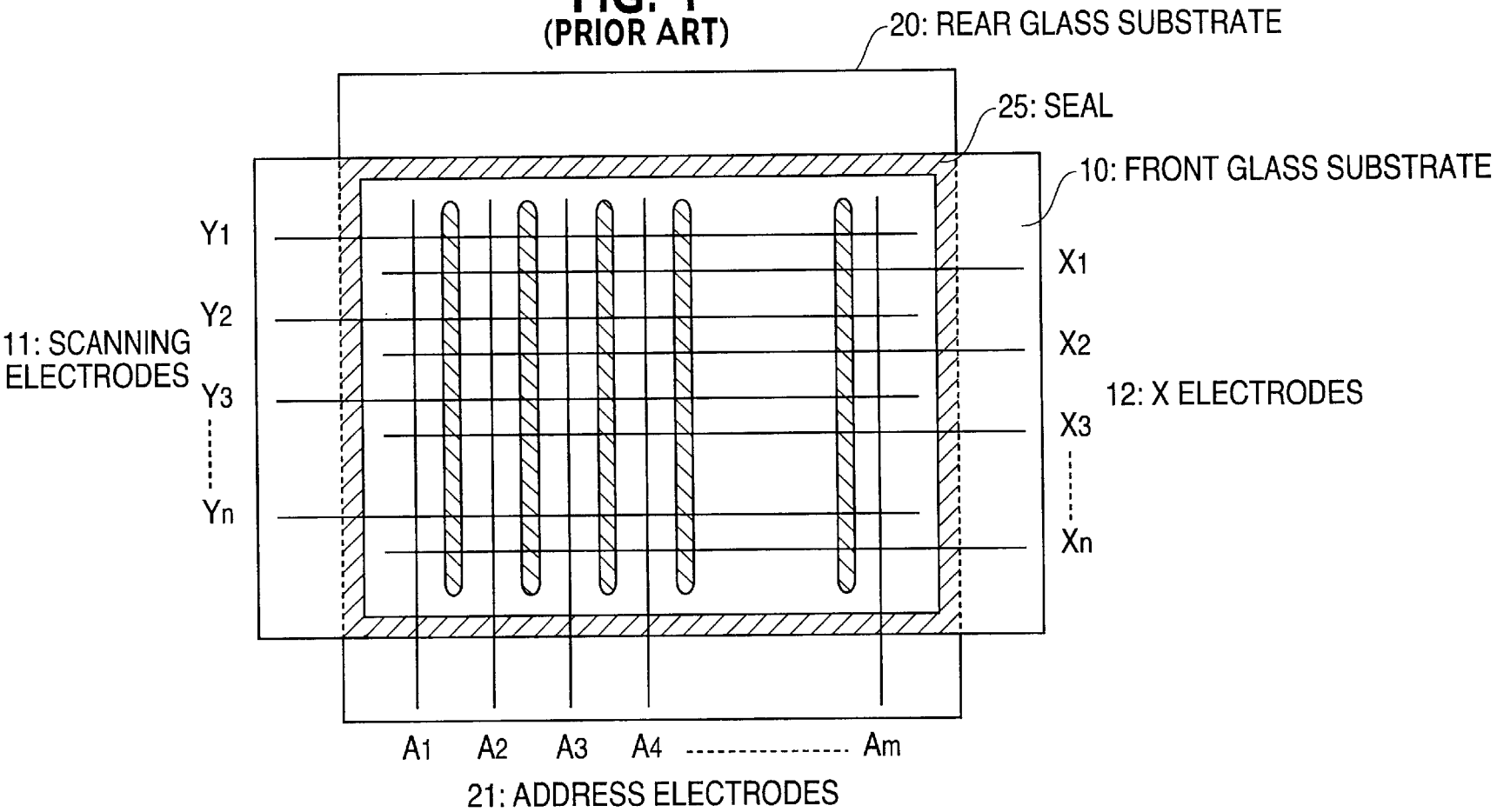
FIG. 1 (PRIOR ART)
FIG. 1 is a plan view of the structure of a PDP of a display apparatus according to the present invention.
Figure 2:
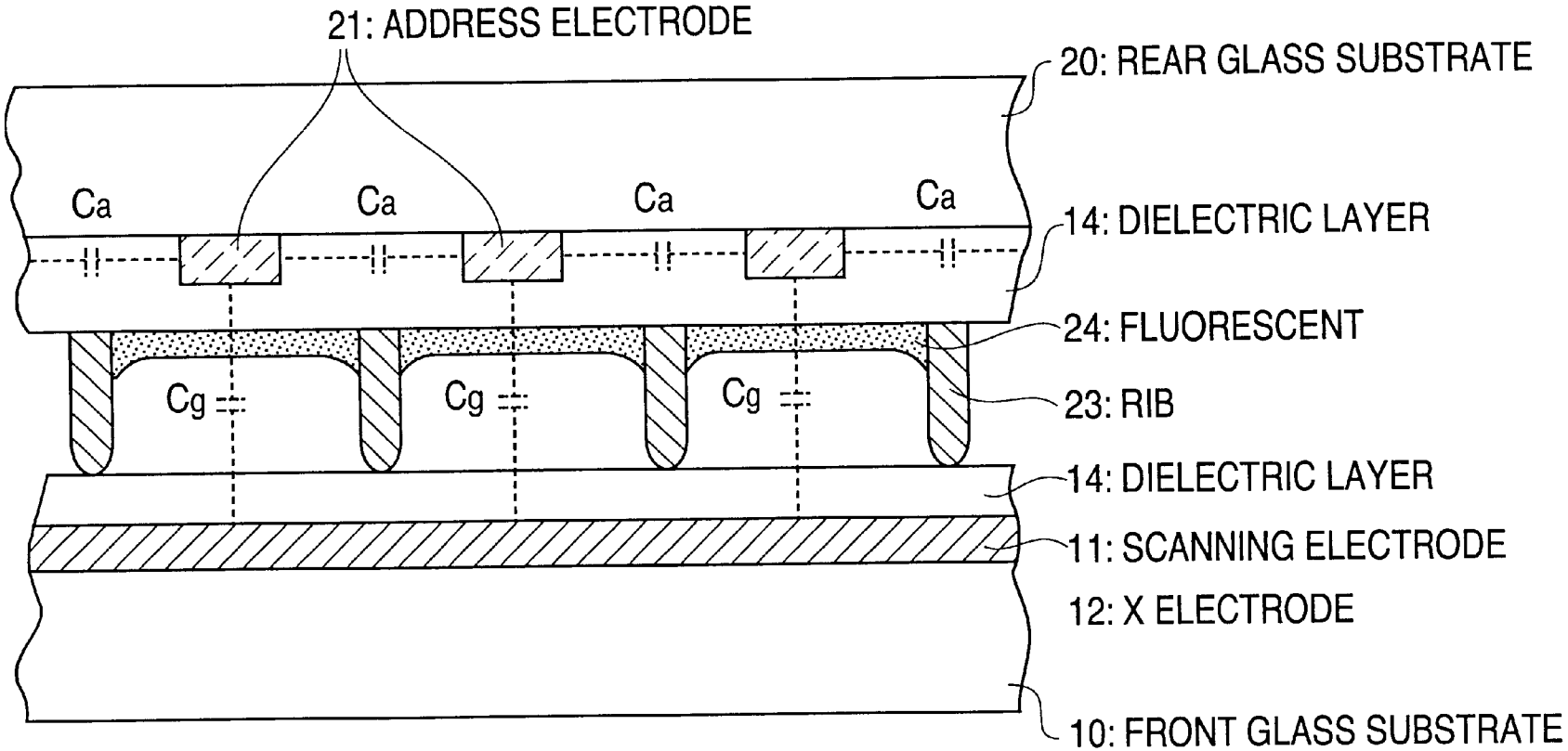
FIG. 2 (PRIOR ART)
FIG. 2 is a fragmentary cross-sectional view of the structure of the PDP.

FIGS. 1 and 2 are plan and fragmentary cross-sectional views, respectively, of the structure of a PDP of a display apparatus according to the present invention. The structure of the PDP will be described below with reference to FIGS. 1 and 2.

The PDP has a front glass substrate 10 on which there are disposed scanning electrodes 11 represented by Y1~Yn and X electrodes 12 represented by X1~Xn, the scanning electrodes 11 and the X electrodes 12 alternating with each other. The electrodes 11 and the X electrodes 12 are covered with a dielectric layer 14. The PDP also has a rear glass substrate 20 on which there are disposed address electrodes 21 represented by A1~Am in perpendicular relation to the X electrodes 12 and the scanning electrodes 11. The address electrodes 21 are covered with a dielectric layer 14. Partitions or ribs 23 made of a dielectric material are disposed in positions between the address electrodes 21, with a fluorescent layer 24 being disposed on the dielectric layer 14 and the partitions 23.

The PDP displays an image as follows: A voltage is applied between the address electrodes 21 and the scanning electrodes 11 to generate a plasma discharge, and a wall charge produced with the plasma discharge is stored on the surface of the dielectric layer 14. Thereafter, sustaining pulses are applied alternatively between the X electrodes 12 and the scanning electrodes 11 to repeat sustained discharges between the X electrodes 12 and the scanning electrodes 11 at pixels where the wall charge is stored. The sustained discharges are repeated for longer and shorter times to display gradational images. Red, blue, and green fluorescent layers are employed to display color images.

Figure 3:
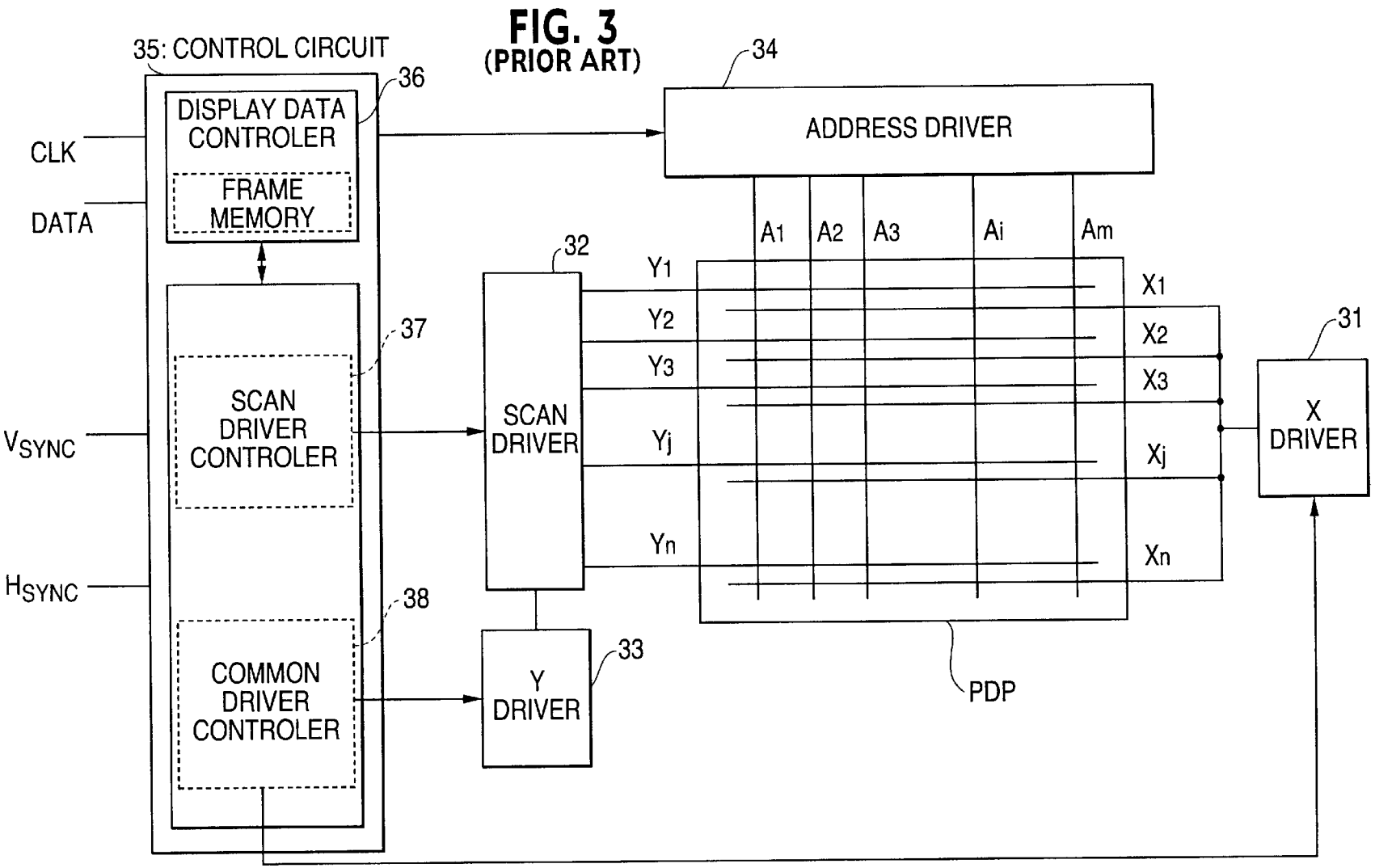
FIG. 3 (PRIOR ART)
FIG. 3 is a block diagram of the display apparatus which includes the PDP and a driver circuit therefor.
Figure 4:
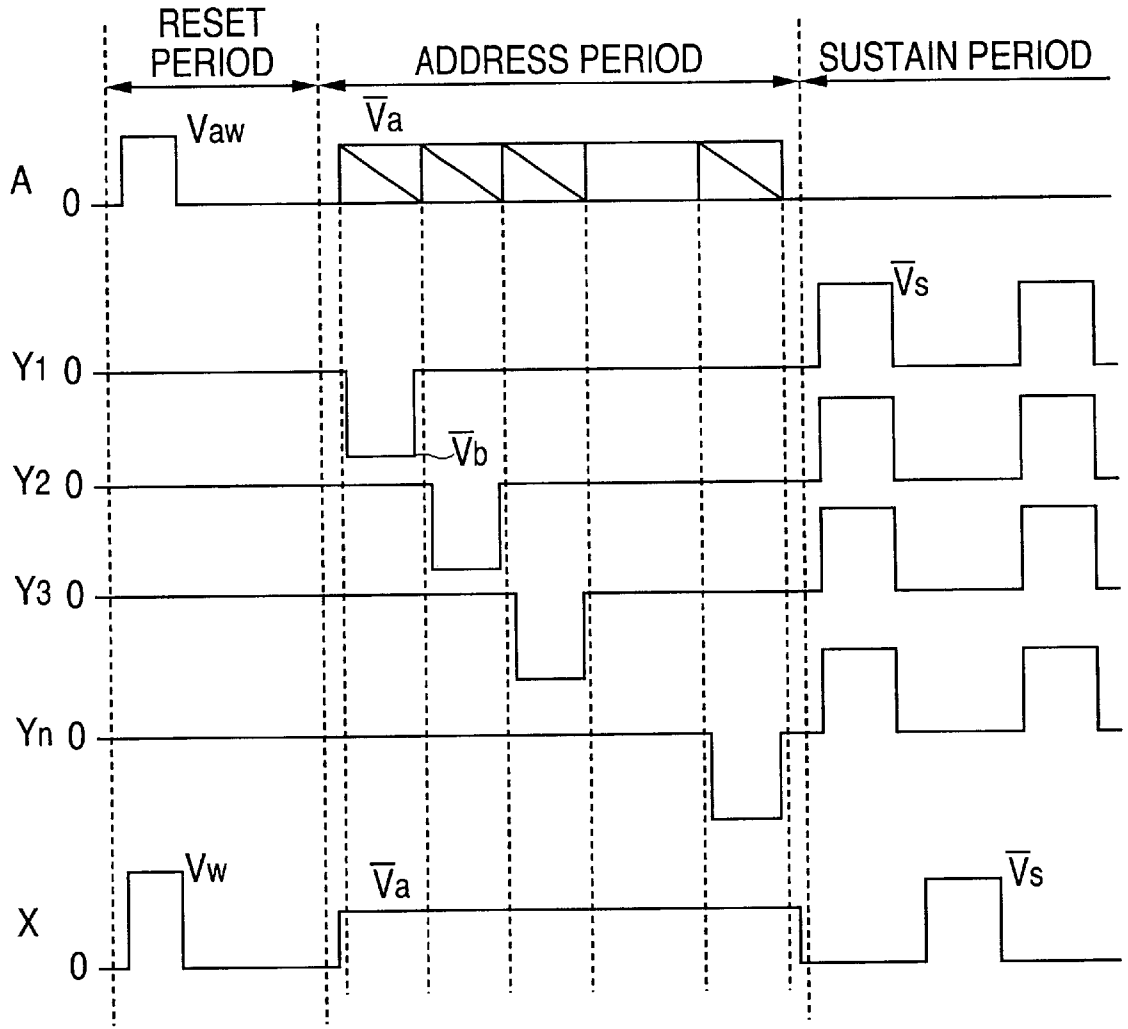
FIG. 4 (PRIOR ART)
FIG. 4 is a diagram showing drive pulse signals applied from the driver circuit to respective electrodes.

FIG. 3 shows in block form the display apparatus which includes the PDP and a driver circuit therefor. FIG. 4 shows drive pulse signals applied from the driver circuit to the respective electrodes.

As shown in FIG. 3, a control circuit 35 is supplied with a vertical synchronizing signal Vsync, a horizontal synchronizing signal Hsync, image data DATA, and a dot clock CLK. The control circuit 35 has a display data controller 36 which samples the image data DATA with the dot clock CLK and converts the image data DATA for gradational image display, and stores generated image data in a built-in frame memory. The display data stored in the frame memory are sent to an address driver 34. The control circuit 35 also has a scanning driver controller 37 which outputs a predetermined scanning timing signal to a scanning driver 32 for energizing the scanning electrodes Y, and a common driver controller 38 which outputs a predetermined drive timing signal to a Y common driver 33 and an X common driver 31 for energizing respectively the scanning electrodes Y and the X electrodes which are connected in common.

Energization of the electrodes for displaying an image with the driver circuit shown in FIG. 3 will be described below with reference to FIG. 4. As disclosed in U.S. Pat. No. 5,541,618, for example, one frame period is divided into a plurality of subframe periods each comprising a resetting period, an address period, and a sustained discharge period. In the resetting period, a resetting pulse Vw is applied to all the X electrodes for forcibly generating a plasma discharge between the X electrodes and the scanning electrodes. Because of a potential developed by charges which are generated by the plasma discharge, discharges are caused again between the X electrodes and the scanning electrodes, neutralizing wall charges at all the pixels.

In the address period, the scanning driver 32 generates negative scanning pulses Vb successively for the scanning electrodes Y1~Yn. In timed relation to the negative scanning pulses Vb, the address driver 34 generates a positive address voltage pulse Va corresponding to the display data for each of the address electrodes. At this time, the X electrodes are kept at a voltage Va by the X common driver 31. In the address period, therefore, a plasma discharge is generated between the scanning electrodes 11 an the address electrodes 21 at pixels corresponding to the image data. Each time the scanning electrodes are successively scanned downwardly, the address driver 34 generates an H level (Va(V)) or an L level (0(V)) to be applied to the address electrodes 21 based on charges and discharges according to the display data.

For those pixels which have been discharged in the address period, wall charges due to discharges are stored on the dielectric layer 14.

In the sustained discharge period, sustaining voltage pulses Vs are generated and applied alternately to all the X electrodes and the scanning electrodes (Y electrodes) by the X common driver 31 and the Y common driver 33. The sustaining voltage pulses Vs cause only those pixels which have been discharged and have stored wall charges in the address period to repeat discharging between the X electrodes and the scanning electrodes. By controlling the number of sustaining voltage pulses, the brightness of the pixels is controlled. Image gradations are displayed based on a combination of sustained discharge periods in a plurality of subframes.

Principles of the Present Invention

Prior to describing the principles of the present invention, charging and discharging which occur when pulses Va are generated and applied to the address electrodes 21 will first be described below. For generating and applying pulses to the address electrodes 21, as shown in FIG. 2, it is necessary to charge and discharge capacitances Ca between adjacent ones of the address electrodes 21 and capacitances Cg between the address electrodes 21 and the scanning electrodes 11 and the X electrodes 12 both of which confront the address electrodes 21.

Figure 5:
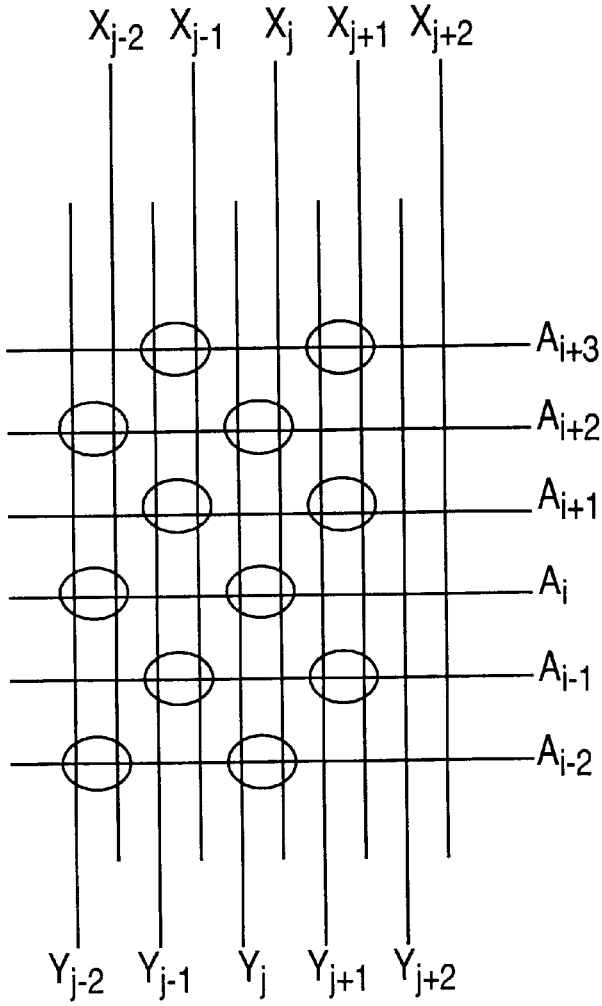
FIG. 5 is a diagram showing a pattern which is displayed when charging and discharging take place most frequently.

FIG. 5 shows a pattern which is displayed when such charging and discharging of the capacitances takes place most frequently. Of the pixels at the points of intersection between the Y electrodes and the address electrodes, only those pixels which are represented by circles are energized (discharged), and the other pixels are not energized. The energized pixels are arranged in a zigzag grid pattern. For such a zigzag grid display pattern in a non-interlaced display mode, the scanning electrodes Y are scanned sequentially downwardly and address pulses Va according to the display data are applied to the address electrodes in synchronism with the scanning of the scanning electrodes Y. To display the above zigzag grid display pattern, therefore, the address electrodes are required to be charged and discharged most frequently. In an interlaced display mode, charging and discharging occur most frequently for displaying a zigzag grid display pattern on every other two pixels.

Figure 6:
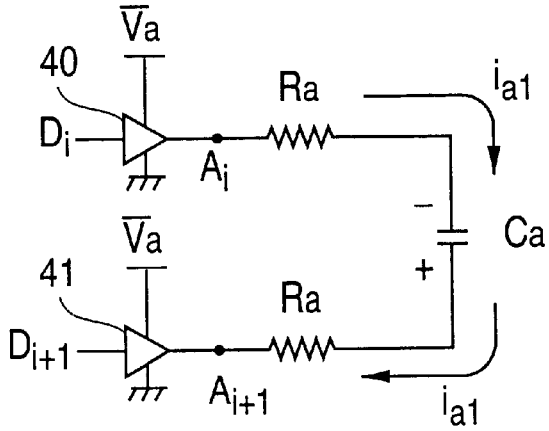
FIG. 6 is a circuit diagram of an equivalent circuit at the time a capacitance Ca between adjacent address electrodes is charged and discharged.
Figure 7:
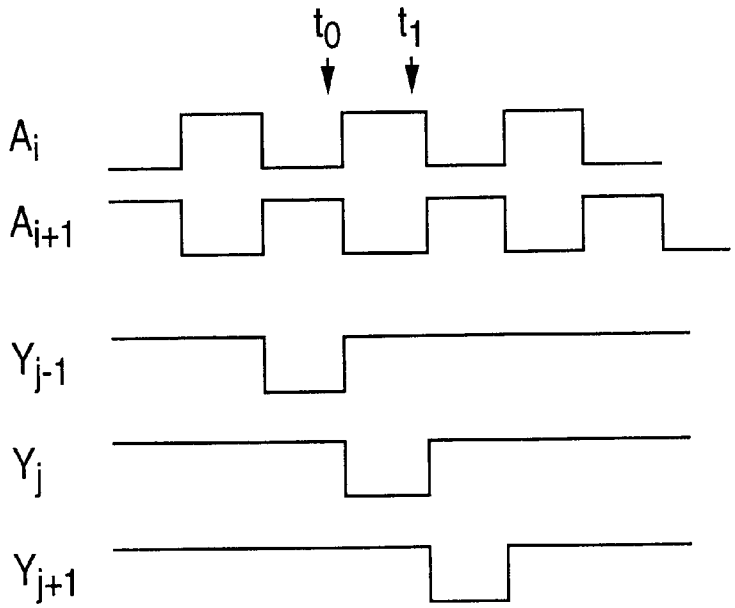
FIG. 7 is a diagram of drive pulse signals in an address period for a zigzag grid display pattern.
Figure 8:
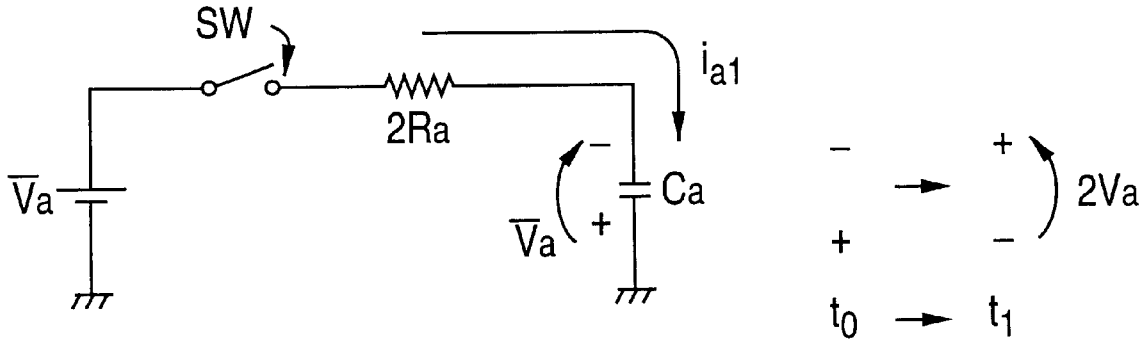
FIG. 8 is a circuit diagram of an equivalent circuit for determining an amount of consumed electric power when the drive pulse signals shown in FIG. 7 are to be applied in the circuit shown in FIG. 6.

FIG. 6 shows an equivalent circuit at the time a capacitance Ca between adjacent two of the address electrodes is charged and discharged. FIG. 7 shows drive pulse signals in an address period for the above zigzag grid display pattern. FIG. 8 shows an equivalent circuit for determining an amount of consumed electric power when the drive pulse signals shown in FIG. 7 are to be applied in the circuit shown in FIG. 6. The electric power consumed when the capacitance Ca between the adjacent address electrodes is charged and discharged in FIGS. 6 through 7 is determined as follows:

For displaying the zigzag grid display pattern shown in FIG. 5, it is necessary to apply pulse signals of opposite polarities to adjacent address electrodes $A_i$, $A_{i+1}$ shown in FIG. 7. As shown in FIG. 7, the pulse signal applied to the address electrode $A_i$ is of an L level and the pulse signal applied to the address electrode $A_{i+1}$ is of an H level at a time $t_0$ when a scanning electrode $Y_{j-1}$ is selected, and the pulse signal applied to the address electrode $A_i$ is inverted to an H level and the pulse signal applied to the address electrode $A_{i+1}$ is inverted to an L level at a time $t_1$ when a next scanning electrode $Y_j$ is selected. Therefore, when the address pulse changes its level from the time $t_0$ to the time $t_1$, as shown in FIG. 6, a current $i_{a1}$ flows from a power supply Va of a driver 40 of the address electrode $A_i$ through a parasitic resistance Ra, which includes an on-state resistance of a switching element in the driver 40 and the resistance of interconnections of the address electrode $A_i$, etc., into the capacitance Ca, thereby charging the capacitance Ca. The capacitance Ca is discharged when a current $i_{al}$ flows from the capacitance Ca through a parasitic resistance Ra to a ground power supply of a driver 41 of the address electrode $A_{i+1}$. The relationship between the current $i_{a1}$, the capacitance Ca, and the resistance Ra with respect to the charging and discharging of the capacitance Ca is expressed by the equivalent circuit shown in FIG. 8. Since the current $i_{aa}$ flows the two series-connected resistances Ra as shown in FIG. 6, the resistance is indicated by 2Ra in FIG. 8. The charging and discharging of the address electrodes 40, 41 means that the capacitance Ca is charged from −Va to +Va when the power supply Va is connected to the capacitance Ca at the time a switch SW is closed as shown in FIG. 8.

The amount of electric power consumed from the time to to the time $t_1$ is calculated according to the model shown in FIG. 8. The current $i_{a1}$ is indicated by 2Va/2Ra at the time $t_0$ after the address pulses changes their levels. When t>0, the current $i_{a1}$ is reduced according to an exponential function with a constant of 2CaRa. Therefore, the current $i_{a1}$ is expressed by:

$$i_{al} = \frac{2Va}{2Ra} e^{-\frac{t}{2CaRa}} = \frac{Va}{Ra} e^{-\frac{t}{2CaRa}} \quad (1)$$

Since the time constant is large as indicated at $i_{a1}$ in FIG. 11 (described later on), the current $i_{a1}$ has a waveform with a long duration time.

An amount of energy $E_{a1}$ which is supplied from the power supply to apply one address pulse is expressed by:

$$E_{a1} = \int_0^\infty Vai_{a1}\,dt = \frac{Va^2}{Ra}\int_0^\infty e^{-\frac{t}{2CaRa}}\,dt = \frac{Va^2}{Ra}(-2CaRa)\left(e^{-\frac{t}{2CaRa}}\right)_0^\infty = 2CaVa^2 \quad (2)$$

If it is assumed that the frame frequency is represented by F and the number of scanning electrodes by Yn, then the capacitance Ca is charged Yn/2 times per frame for the address electrode Ai, an amount of electric power $P_{a1}$ (w) consumed per unit time is expressed by:

$$P_{ai} = 2CaVa^2F\frac{Yn}{2} \quad (3)$$

In order to apply address pulses of opposite polarities simultaneously to the adjacent address electrodes $A_i$, $A_{i+1}$, therefore, a charging current is supplied from the power supply Va to the capacitance Ca between the adjacent address electrodes $A_i$, $A_{i+1}$ from −Va to +Va.

Figure 9:
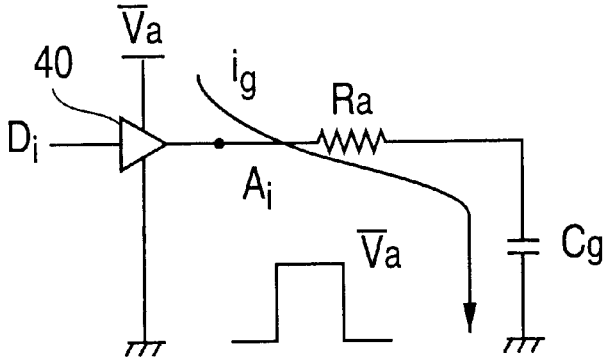
FIG. 9 is a circuit diagram of an equivalent circuit at the time a capacitance Cg between an X electrode and a scanning electrode which are opposite to an address electrode is charged.
Figure 10:
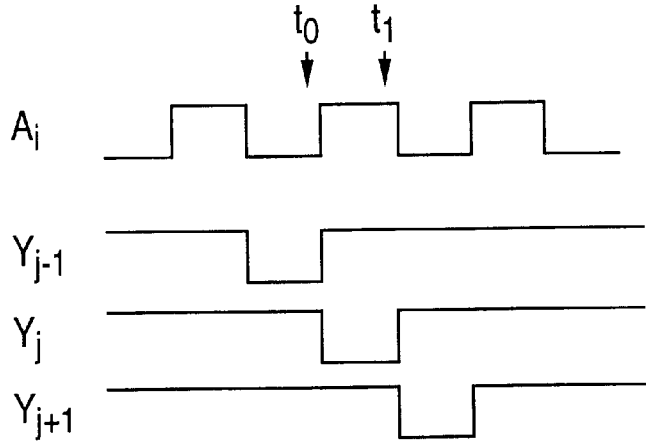
FIG. 10 is a diagram of drive pulse signals applied in an address period to the capacitance Cg for displaying the zigzag grid display pattern.

FIG. 9 shows an equivalent circuit at the time a capacitance Cg between an X electrode and a scanning electrode which are opposite to an address electrode is charged. FIG. 10 shows drive pulse signals applied in an address period to the capacitance Cg for displaying the zigzag grid display pattern. FIG. 11 shows the waveform of a charging current in the equivalent circuit shown in FIG. 9. The electric power consumed when the capacitance Cg between the address electrode and the opposite electrodes is charged in FIGS. 9 through 11 is determined as follows:

Since the opposite electrodes are kept at a fixed potential of 0 V in this example, the equivalent circuit shown in FIG. 9 is relatively simple. The equivalent circuit shown in FIG. 9 illustrates a model in which the capacitance Cg is charged with a current $i_g$ supplied from the driver 40 of the address electrode $A_i$ through the parasitic resistance Ra. The current $i_g$ is represented by:

$$i_g = \frac{Va}{Ra}e^{-\frac{t}{CgRa}} \quad (4)$$

Figure 11:
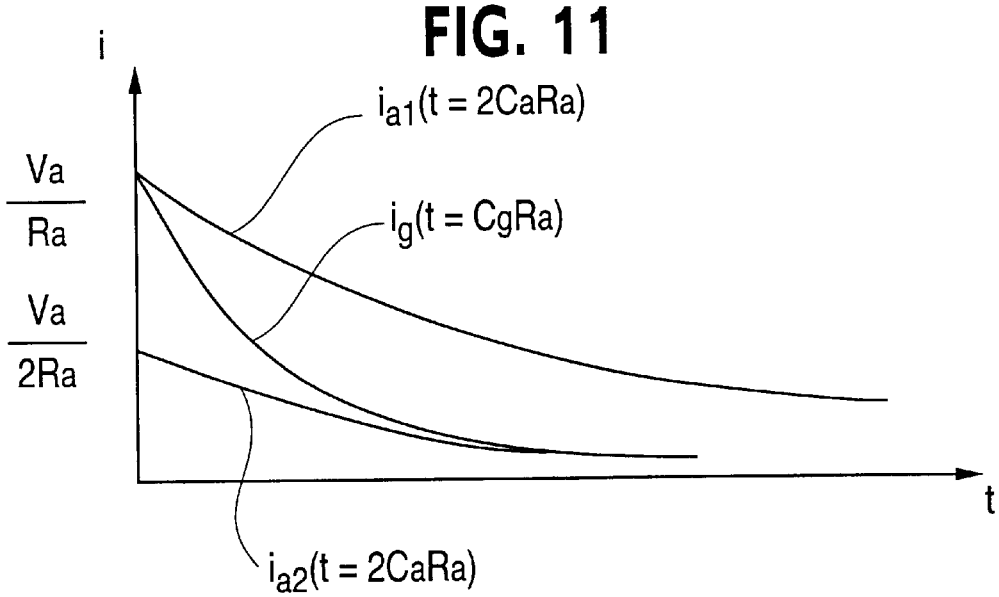
FIG. 11 is a diagram showing the waveform of a charging current in the equivalent circuit shown in FIG. 9.

Therefore, as shown in FIG. 11, the time constant is indicated by CgRa, and the current $i_g$ ceases relatively quickly. since the electrodes opposite to the address electrode across the capacitance Cg are kept at the fixed ground potential, the capacitance Cg is charged from 0 V to Va.

An amount of energy Eg which is supplied from the power supply to apply one address pulse is expressed by:

$$E_g = \int_0^\infty Vai_g\,dt = \frac{Va^2}{Ra}\int_0^\infty e^{-\frac{t}{CgRa}}\,dt = \frac{Va^2}{Ra}(-CgRa)\left(e^{-\frac{t}{CgRa}}\right)_0^\infty = 2CgVa^2 \quad (5)$$

If it is assumed that the frame frequency is represented by F and the number of scanning electrodes by Yn, then the capacitance Cg is charged Yn/2 times per frame for the address electrode Ai, an amount of electric power $P_g$(w) consumed per unit time is expressed by:

$$P_g = CgVa^2F\frac{Yn}{2} \quad (6)$$

As shown in FIG. 2, the capacitance Ca between adjacent two of the address electrodes covered with the dielectric material is generally about twice the capacitance Cg between an address electrode and the electrodes opposite thereto with discharge gases present therebetween. Therefore, as can be seen from a comparison between the equations (3) and (6), the consumed electric power $P_{a1}$ required to charge the capacitance Ca has a large proportion in the total consumed electric power $P=P_{a1}+P_g$ required to apply an address pulse to the address electrode $A_i$. The total electric power consumption for energizing the address electrodes can thus efficiently be reduced by reducing the consumed electric power $P_{a1}$.

Figure 12:
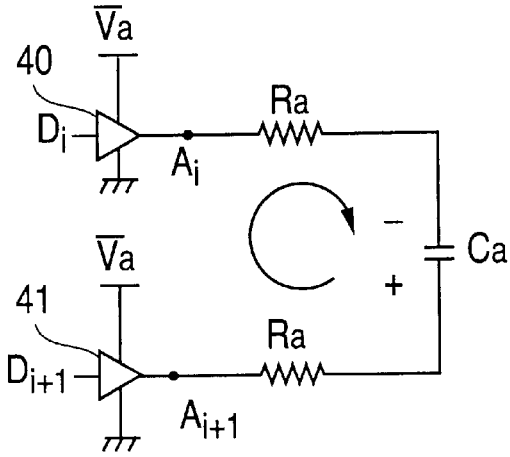
FIG. 12 is a circuit diagram of an equivalent circuit illustrative of the principles of the present invention.

FIG. 12 shows an equivalent circuit illustrative of the principles of the present invention. As described above with respect to the charging and discharging of the capacitance Ca between the adjacent address electrodes, since pulses of opposite polarities are applied simultaneously to the adjacent address electrodes, a charging current is required from the power supply Va to charge the capacitance Ca up to the voltage 2 Va. As indicated by the arrow in FIG. 12, immediately prior to the application of an address pulse from the time to, both the electrodes across the capacitance Ca are short-circuited to equalize the potentials at the electrodes. Thereafter, a pulse is applied to the address electrode. In this manner, it is sufficient for the capacitance Ca to be charged up to the voltage Va.

FIG. 13 shows the waveforms of address pulses according to the principles of the present invention. As shown in FIG. 13, before an address pulse is applied to the address electrode $A_i$, the address pulse applied to the address electrode $A_{i+1}$ adjacent to the address electrode $A_i$ is terminated, keeping both the address electrodes at the ground potential. This means that both the electrodes across the capacitance Ca are short-circuited through ground points of the drivers 40, 41 at a time $t'_0$ in FIG. 13. As a result, the potential of the address electrode $A_{i+1}$ which is higher than the potential of the address electrode $A_i$ by Va at the time to is equivalent to the potential of the address electrode $A_i$ at the time $t'_0$. The same effect appears when both the address pulses applied to the respective electrodes are of an H level (the level of the voltage of the power supply Va) at the time $t'_0$.

FIGS. 14A through 14C show equivalent circuits corresponding to the equivalent circuit shown in FIG. 8. As shown in FIG. 14A, the capacitance Ca is charged in the illustrated direction at the time $t_0$. At the time $t'_0$, as shown in FIG. 14B, the capacitance Ca is connected to ground and discharged, with its electrodes approaching the ground potential or being held at the ground potential. From the time $t'_0$ to the time $t_1$, the capacitance Ca is charged up to the voltage Va with a current $i_{a2}$ supplied from the power supply Va, as shown in FIG. 14C.

Based on the above principles, an amount of electric power consumed for energizing the address electrodes according to the present invention is determined as follows: The charging current $i_{a2}$ is expressed by:

$$i_{a2} = \frac{Va}{2Ra}e^{-\frac{t}{2CaRa}} \quad (7)$$

The voltage to which the capacitance Ca is charged is Va, not 2Va unlike the conventional arrangement. As indicated by $i_{a2}$ in FIG. 11, the time constant for the current $i_{a2}$ is 2CaRa, which is the same as the time constant for the current $i_{a1}$. However, the current $i_{a2}$ has an initial peak value which is half the initial peak value of the current $i_{a1}$. Therefore, the waveform of the current $i_{a2}$ is relatively small. An amount of energy $E_{a2}$ which is supplied from the power supply to apply one address pulse is expressed by:

$$E_{a2} = \int_0^\infty Vai_{a2}\,dt = \frac{Va^2}{2Ra}\int_0^\infty e^{-\frac{t}{2CaRa}}\,dt = \frac{Va^2}{2Ra}(-2CaRa)\left(e^{-\frac{t}{2CaRa}}\right)_0^\infty = CaVa^2 \tag{8}$$

As a consequence, an amount of electric power $P_{a2}$(w) consumed per unit time is expressed by:

$$P_{a2} = CaVa^2F\frac{Yn}{2} \tag{9}$$

According to the principles to the present invention, as is apparent from a comparison between the equations (3) and (9), the amount of consumed electric power required to charge the capacitance between the adjacent address electrodes is reduced to ½. The above calculations are based on the assumption that the capacitance Ca is fully discharged at the time $t'_0$. Therefore, the amount by which the consumed electric power is reduced becomes smaller as the period of the time $t'_0$ is shorter.

Figure 15:
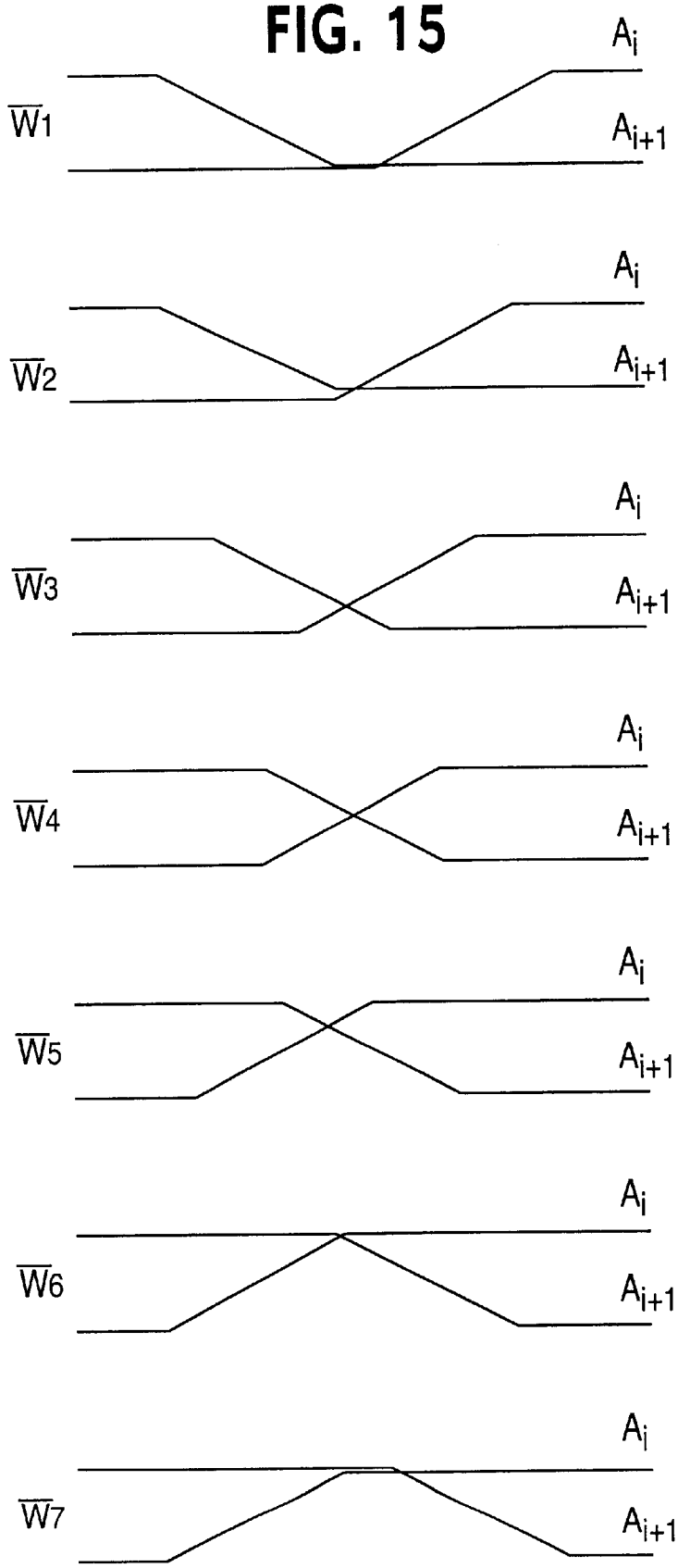
FIG. 15 is a diagram showing various relationships W1~W7 between the waveforms of drive pulses applied to adjacent address electrodes.
Figure 16:
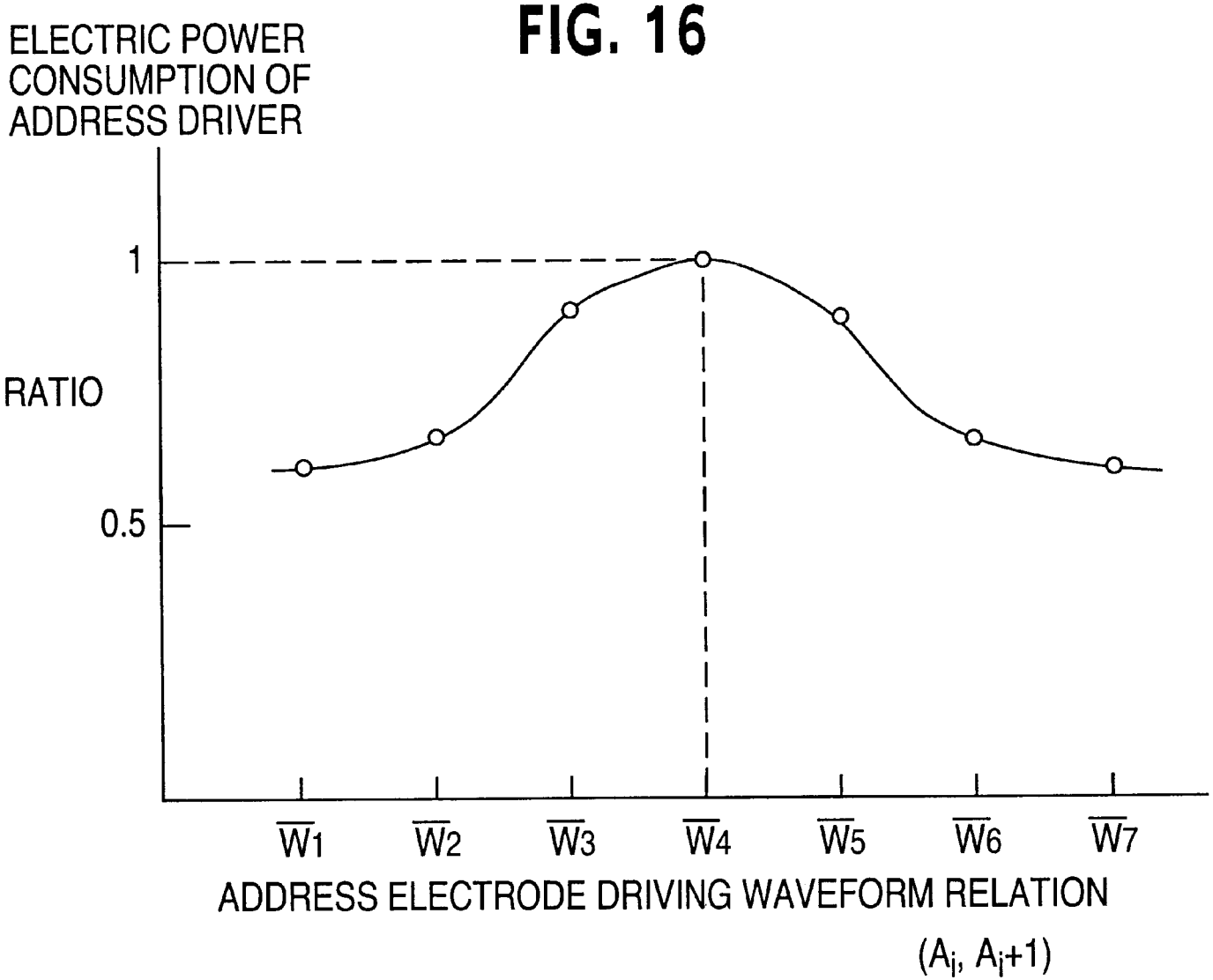
FIG. 16 is a diagram showing relative values of electric power consumed by an address driver in the relationships W1~W7 shown in FIG. 15.

In FIG. 15 shows various relationships W1~W7 between the waveforms of drive pulses applied to the adjacent address electrodes. FIG. 16 is a graph showing relative values of electric power consumed by the address driver in the relationships W1~W7.

In FIG. 15, the drive pulses applied respectively to the address electrodes $A_i$, $A_{i+1}$ are shown as rising and falling at the same gradient. In the relationship W4, the drive pulses simultaneously start rising and falling and simultaneously finish rising and falling, a pattern equivalent to the conventional pattern described with reference to FIGS. 6, 7, and 8. Therefore, the electric power consumption is maximum with the relationship W4.

In the relationship W1, after the falling of the drive pulse applied to the address electrode $A_{i+1}$ ends, the drive pulse applied to the address electrode $A_i$ starts to rise. In the relationship W2, the drive pulse applied to the address electrode $A_{i+1}$ finishes falling and the drive pulse applied to the address electrode $A_i$ starts rising substantially at the same time. In the relationship W3, the drive pulse applied to the address electrode $A_i$ starts to rise a predetermined time after the drive pulse applied to the address electrode $A_{i+1}$ starts falling. In the relationships W1, W2, W3, there is a period in which the drive pulses coincide with each other on an L level side.

In the relationship W5, the drive pulse applied to the address electrode $A_{i+1}$ starts to fall a predetermined time after the drive pulse applied to the address electrode $A_i$ starts rising. In the relationship W6, the drive pulse applied to the address electrode $A_{i+i}$ starts falling and the drive pulse applied to the address electrode $A_i$ finishes rising substantially at the same time. In the relationship W7, after the rising of the drive pulse applied to the address electrode $A_i$ ends, the drive pulse applied to the address electrode $A_{i+1}$ starts to fall. In the relationships W5, W6, W7, there is a period in which the drive pulses coincide with each other on an H level side. Therefore, the capacitance Ca is short-circuited through the power supply Va or its common interconnection.

As shown in FIG. 16, the electric power consumption is maximum with the relationship W4, and gradually decreases toward the relationship W1 or W7. This means, as described above, that the consumed electric power is reduced as the short-circuiting period at the time $t'_0$ shown in FIG. 14 is longer. The reduction in the electric power consumption is saturated when a certain time difference is reached.

Figure 17:
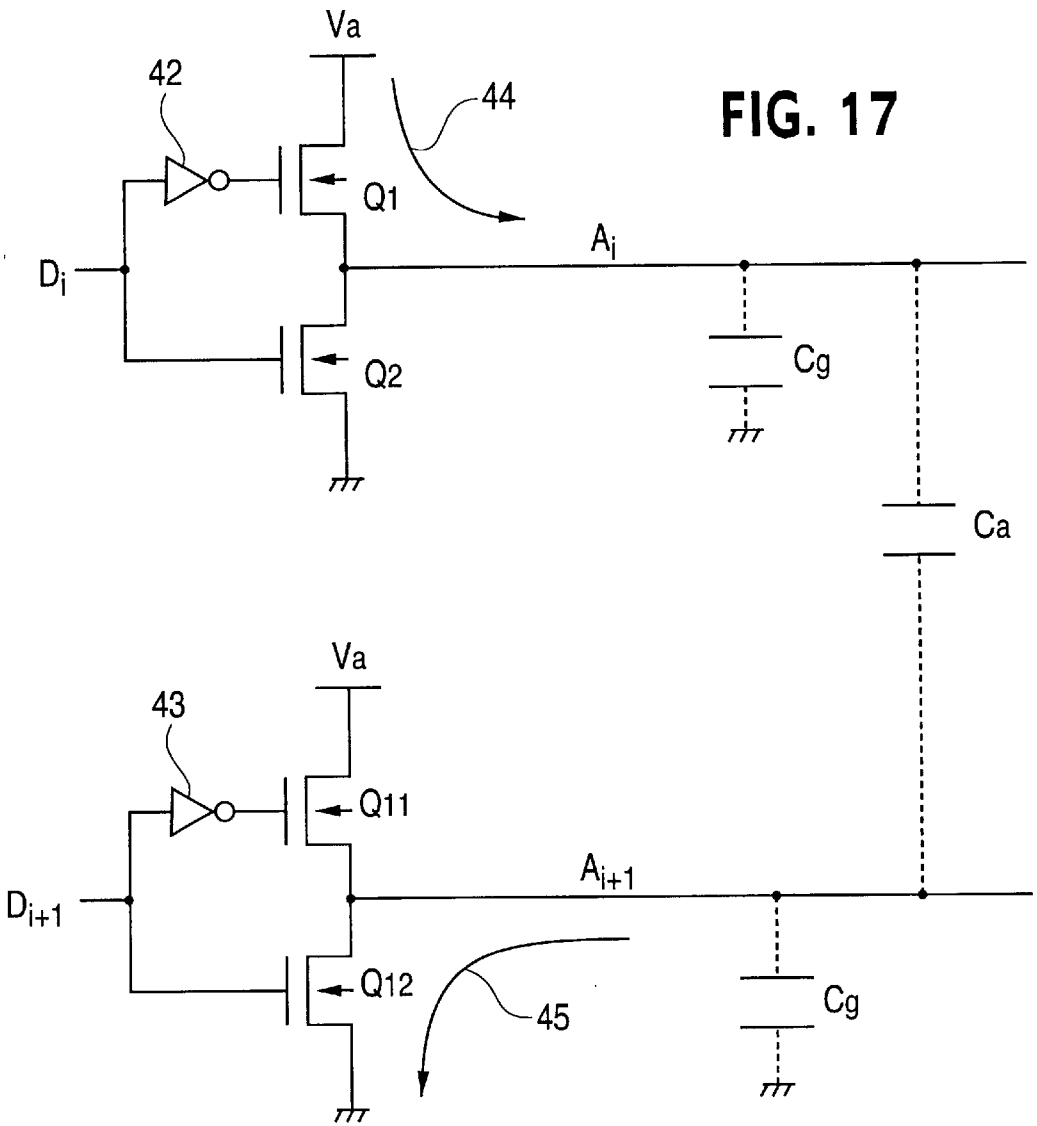
FIG. 17 is a circuit diagram of a general address driver connected to address electrodes.

FIG. 17 shows a general address driver connected to the address electrodes $A_i$, $A_{i+1}$. As shown in FIG. 17, the address driver has at least N-type pull-up transistors Q1, Q11, N-type pull-down transistors Q2, Q12, and inverters 42, 43 for applying signals of opposite polarities to the gates of these transistors. When the pull-up transistors Q1 is turned on, the potential of the address electrode $A_i$ is increased by a drive current 44. When pull-down transistor Q12 is turned on, the potential of the address electrode $A_{i+1}$ is lowered by a drive current 45. Therefore, the relationships W1~W7 shown in FIG. 15 can be achieved by varying the timing with which the transistors Q1, Q12 shown in FIG. 17 are turned on.

The present invention is also effective when the drive pulses rise and fall at largely different respective gradients even if they rise and fall at the same time. Such drive pulses may be drive pulses which rise quickly but fall slowly. These drive pulses can be generated by, for example, increasing the size of the pull-down transistors (FIG. 17) or reducing the on-state resistance thereof, and reducing the size of the pull-up transistors or increasing the on-state resistance thereof, thereby making the time constants for the rising and falling of the drive pulses being differently. According to another scheme, input signals at a stage preceding these driver transistors may have different gradients to make the time constants different for the rising and falling of the drive pulses.

It has been stated above that the electric power consumption is large when the drive pulses applied the adjacent address electrodes rise and fall at the same time. Heretofore, the drive pulses may have negligibly different timings or may rise and fall at negligibly different gradients because of time constant variations or transistor size variations. According to the principles of the present invention, however, the drive pulses have respective timings which are designed so as to be intentionally large or rise and fall at respective gradients which are designed so as to be largely different from each other. Alternatively, the drive pulses may have different timings respectively, and rise and fall at different gradients, respectively.

In an example of PDP which was experimentally confirmed by the inventor, the electric power consumption was largely reduced by introducing a 5% difference with respect to the pulse durations of the drive pulses. A larger reduction in the electric power consumption was achieved by combining the direction in which the timings of the drive pulses differ from each other and the direction in the gradients of the drive pulses differ from each other according to the principles of the present invention.

Furthermore, a substantial reduction in the electric power consumption can be more reliably accomplished if attention is directed to how the voltage level of a cross point where the drive pulses applied to the adjacent address electrodes change to opposite phase is positioned relatively to a higher potential level (power supply potential level). Specifically, the electric power consumption can be reduced by making the potential at the cross point closer to the higher potential level (power supply potential level) or closer to the lower potential level (ground potential level). A large reduction in the electric power consumption can be achieved particularly when the potential at the cross point is 90% or more of the rising or falling voltage or 10% or less of the rising or falling voltage.

A person skilled in the art usually thinks that when a pulse rises from an L level, it starts rising from the L level if its voltage level increases past 10% of the amplitude voltage, and it finishes rising from the L level if its voltage level increases past 90% of the amplitude voltage from the L level, and that when a pulse falls from an H level, it starts falling from the H level if its voltage level decreases past 90% of the amplitude voltage and finishes falling if its voltage level decreases past 10% of the amplitude voltage. According to this criterion, if the voltage level of the cross point is 10% or less of the higher potential level, then the drive pulses start rising after they finish falling, and if the voltage level of the cross point is 90% or more of the higher potential level, then the drive pulses start falling after they finish rising.

Figure 26A:
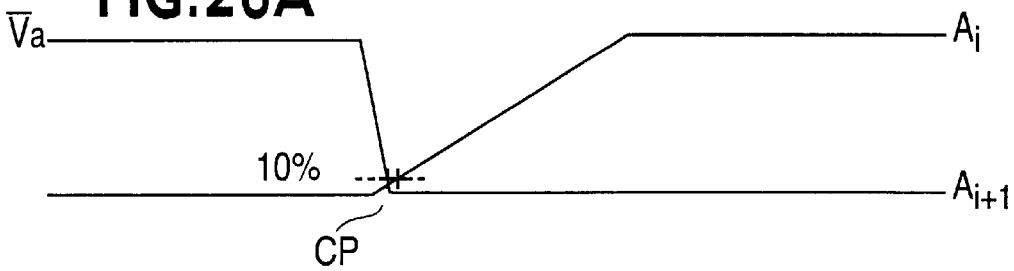
FIGS. 26(*a*) through 26(*f*) are diagrams showing the waveforms of drive pulses applied to address electrodes.
Figure 26B:
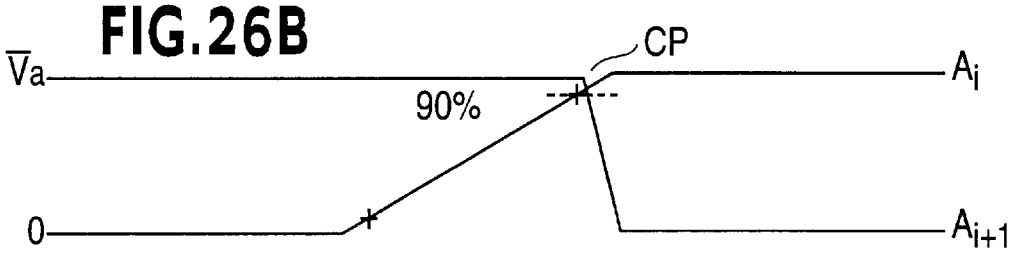
Figure 26C:
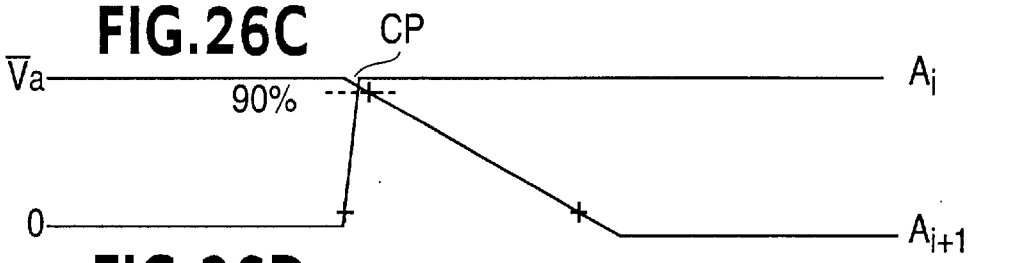
Figure 26D:
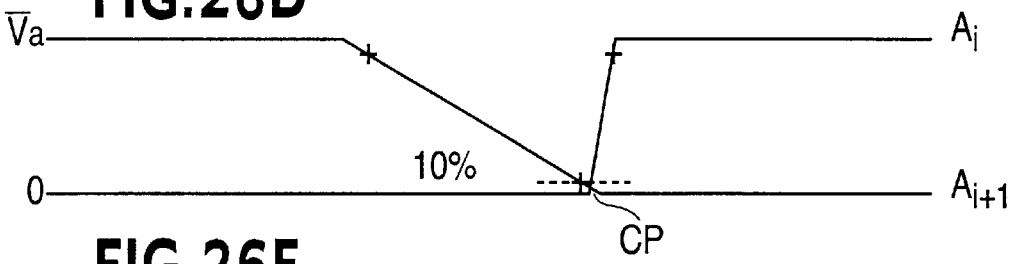
Figure 26E:
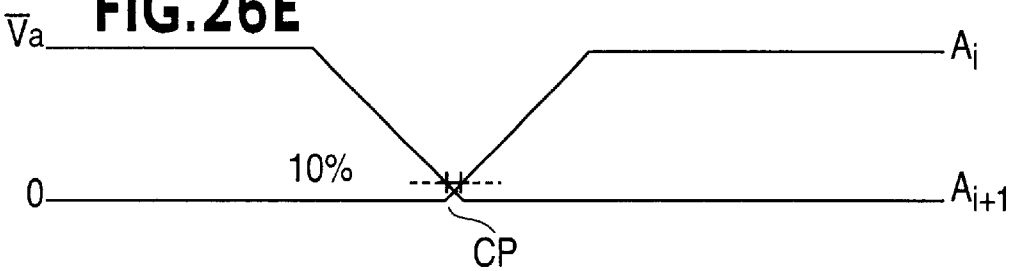
Figure 26F:
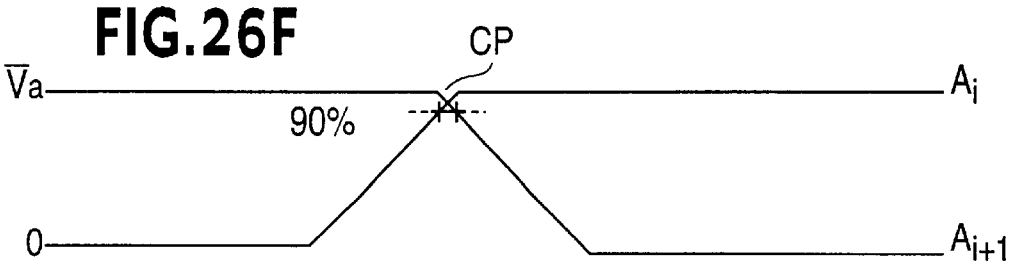

FIGS. 26A through 26F show the waveforms of drive pulses applied to the adjacent address electrodes. In either one of the illustrated waveforms, the potential of a cross point CP is 90% or more of the higher potential level or 10% or less of the higher potential level. In FIGS. 26A and 26B, the drive pulse applied to the address electrode $A_i$ rises at a gradient, and the drive pulse applied to the address electrode $A_{i+1}$ falls sharply. In FIGS. 26C and 26D, the drive pulse applied to the address electrode $A_i$ rises sharply, and the drive pulse applied to the address electrode $A_{i+1}$ falls at a gradient. In FIGS. 26E and 26F, both the drive pulses applied to the address electrodes $A_i$, $A_{i+1}$ rise and fall at gradients. Although not shown, if the amplitudes of the drive pulses applied to the address electrodes $A_i$, $A_{i+1}$ differ from each other, then the potential of the cross point CP may be 90% or more or 10% of less of either one of the amplitude voltages of the drive pulses.

With the drive pulses thus designed, the electric power consumed by the address driver for charging the capacitance between the adjacent address electrodes can be reduced to substantially half or to a value close to half.

Examples of Drive Pulses

FIGS. 18 through 21 show, by way of example, the waveforms of drive pulses applied to the adjacent address electrodes. In the illustrated examples, the drive pulses rise and fall vertically, but with different timings. In FIGS. 18 through 21, $t_1$~$t_7$ indicate times at which the scanning period shown in FIG. 4 is switched. The illustrated drive pulses are applied to display the zigzag grid display pattern shown in FIG. 5.

Figure 18:
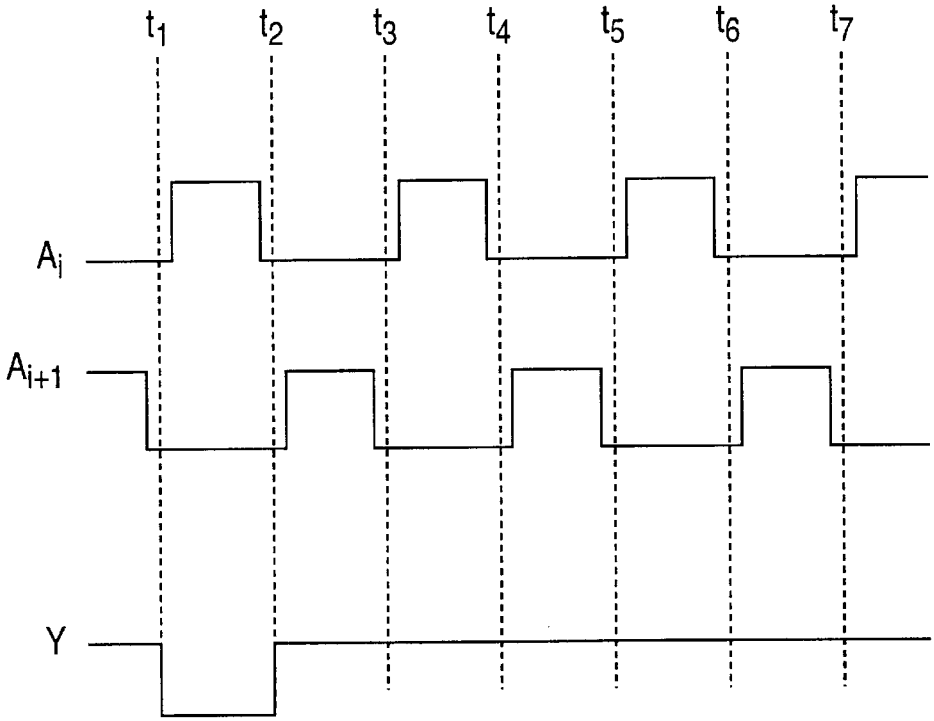
FIG. 18 is a diagram showing the waveforms of drive pulses applied to address electrodes.

In FIG. 18, there is a period in which both the drive pulses applied respectively to the address electrodes $A_i$, $A_{i+1}$ are of an L level at each of the times $t_1$~$t_7$. The drive pulses shown in FIG. 18 have the same relationship as the relationship W1 shown in FIG. 15. Therefore, the drive pulses have a low duty cycle. The driver circuit shown in FIG. 17 is designed such that the pull-up transistors are turned on at a later time and the pull-down transistors are turned on at an earlier time.

Figure 19:
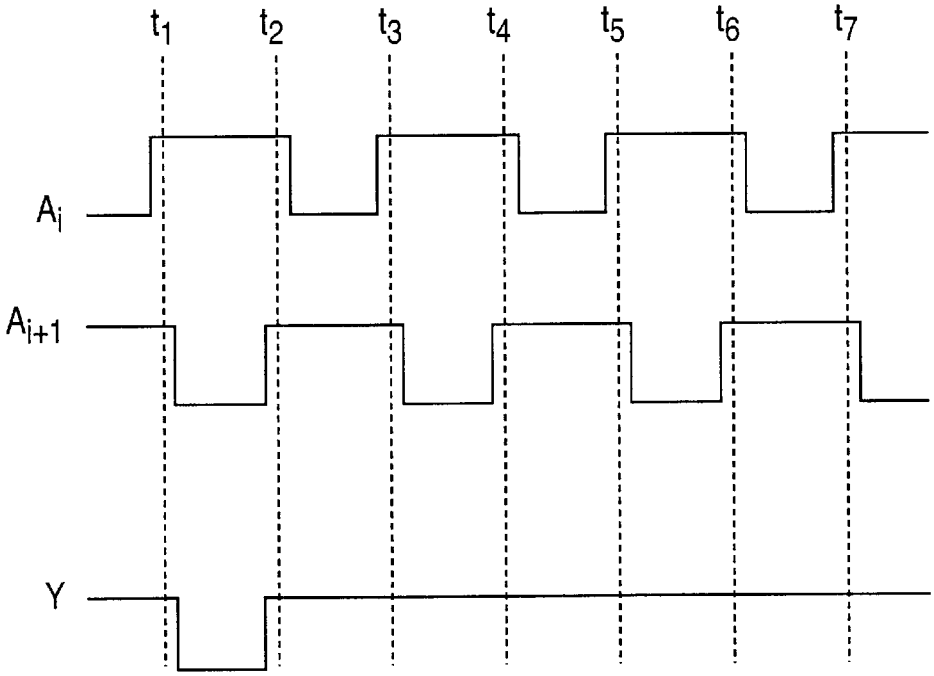
FIG. 19 is a diagram showing the waveforms of drive pulses applied to address electrodes.

In FIG. 19, there is a period in which both the drive pulses applied respectively to the address electrodes $A_i$, $A_{i+1}$ are of an H level (Va level) at each of the times $t_1$~$t_7$. The drive pulses shown in FIG. 19 have the same relationship as the relationship W7 shown in FIG. 15. Therefore, the drive pulses have a high duty cycle. The driver circuit shown in FIG. 17 is designed such that the pull-up transistors are turned on at an earlier time and the pull-down transistors are turned on at a later time.

Figure 20:
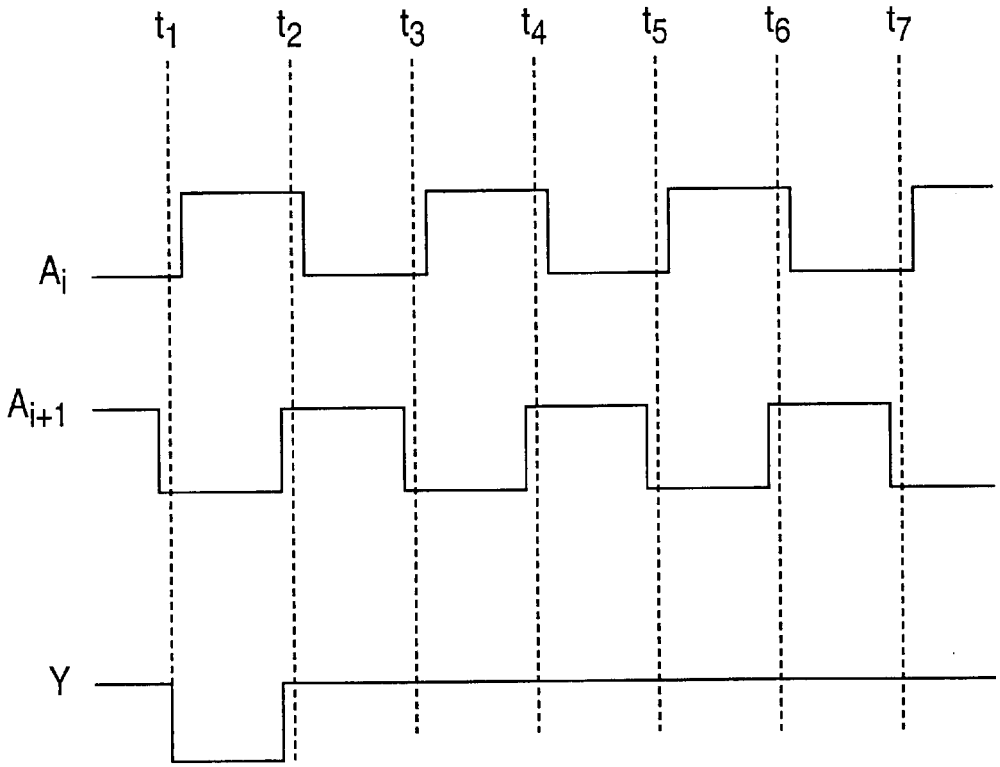
FIG. 20 is a diagram showing the waveforms of drive pulses applied to address electrodes.

In FIG. 20, there is a period in which both the drive pulses applied respectively to the address electrodes $A_i$, $A_{i+1}$ are of an L level at each of the times $t_1$, $t_3$, $t_5$, $t_7$, and there is a period in which both the drive pulses applied respectively to the address electrodes $A_i$, $A_{i+1}$ are of an H level (Va level) at each of the times $t_2$, $t_4$, $t_6$. The drive pulses shown in FIG. 19 have the same relationship as the mixed relationships W1, W7 shown in FIG. 15. The driver circuit shown in FIG. 20 is designed such that the pull-up transistors and the pull-down transistors of the drive circuit for the address electrode $A_i$ are turned on at a later time, and the pull-up transistors and the pull-down transistors of the drive circuit for the address electrode $A_{i+1}$ are turned on at an earlier time.

Figure 21:
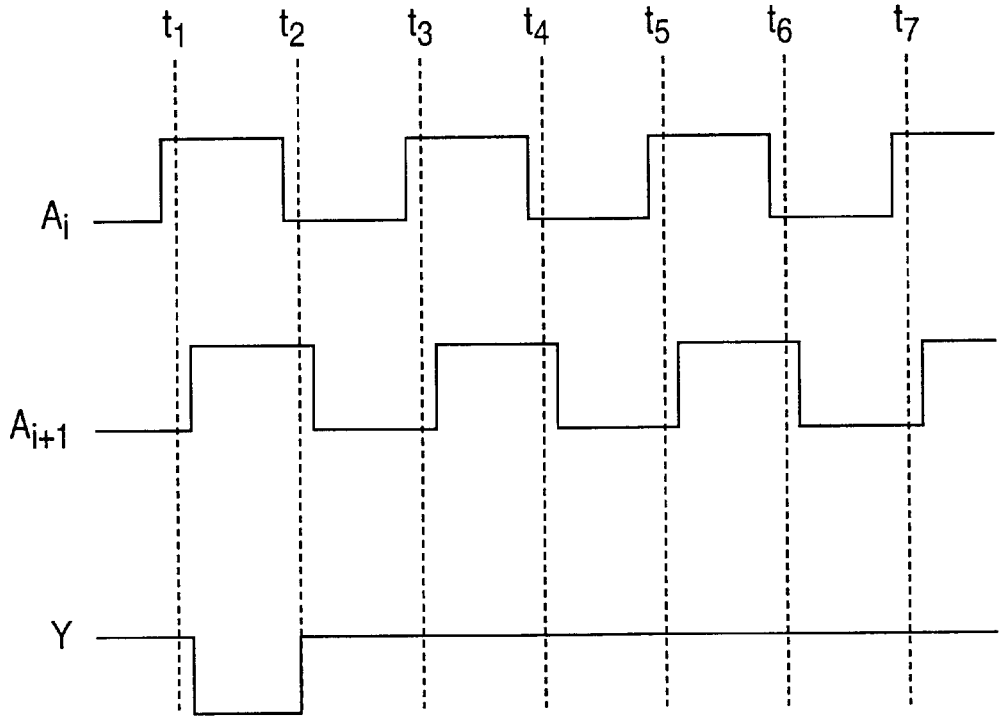
FIG. 21 is a diagram showing the waveforms of drive pulses applied to address electrodes.

The waveforms of the drive pulses shown in FIG. 21 are contrary to the waveforms of the drive pulses shown in FIG. 21. Whereas the drive pulse for the address electrode $A_i$ is applied later and the drive pulse for the address electrode $A_{i+1}$ is applied earlier in FIG. 20, the drive pulse for the address electrode $A_i$ is applied earlier and the drive pulse for the address electrode $A_{i+1}$ is applied later in FIG. 21.

FIGS. 18 through 21 also show a drive pulse for the scanning electrodes Y in addition to the drive signals for the address electrodes $A_i$, $A_{i+1}$. In FIG. 18, the drive pulse for the scanning electrodes Y has a duration which is not reduced because there is no period in which both the drive pulses for the address electrodes $A_i$, $A_{i+1}$ are of an H level. In FIGS. 19~21, however, the scanning electrodes Y are not energized to a negative level in a period in which both the drive pulses for the address electrodes $A_i$, $A_{i+1}$ are of an H level. This is because if the scanning electrodes Y were of an H level when both the adjacent address electrodes $A_i$, $A_{i+1}$ are of a negative level, then a discharge voltage would be applied to both the address electrodes, energizing them.

Figure 22:
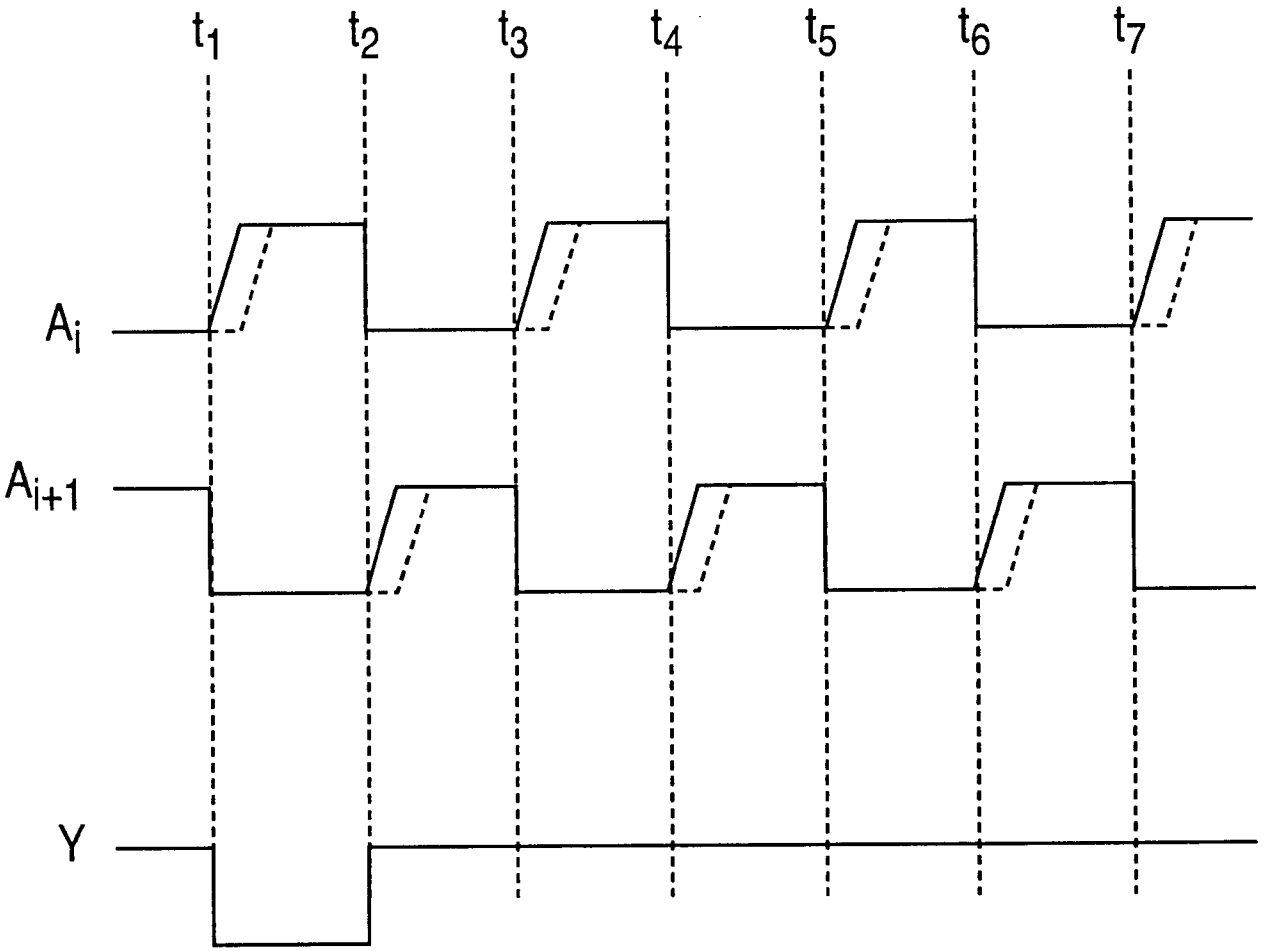
FIG. 22 is a diagram showing the waveforms of other drive pulses applied to address electrodes.
Figure 23:
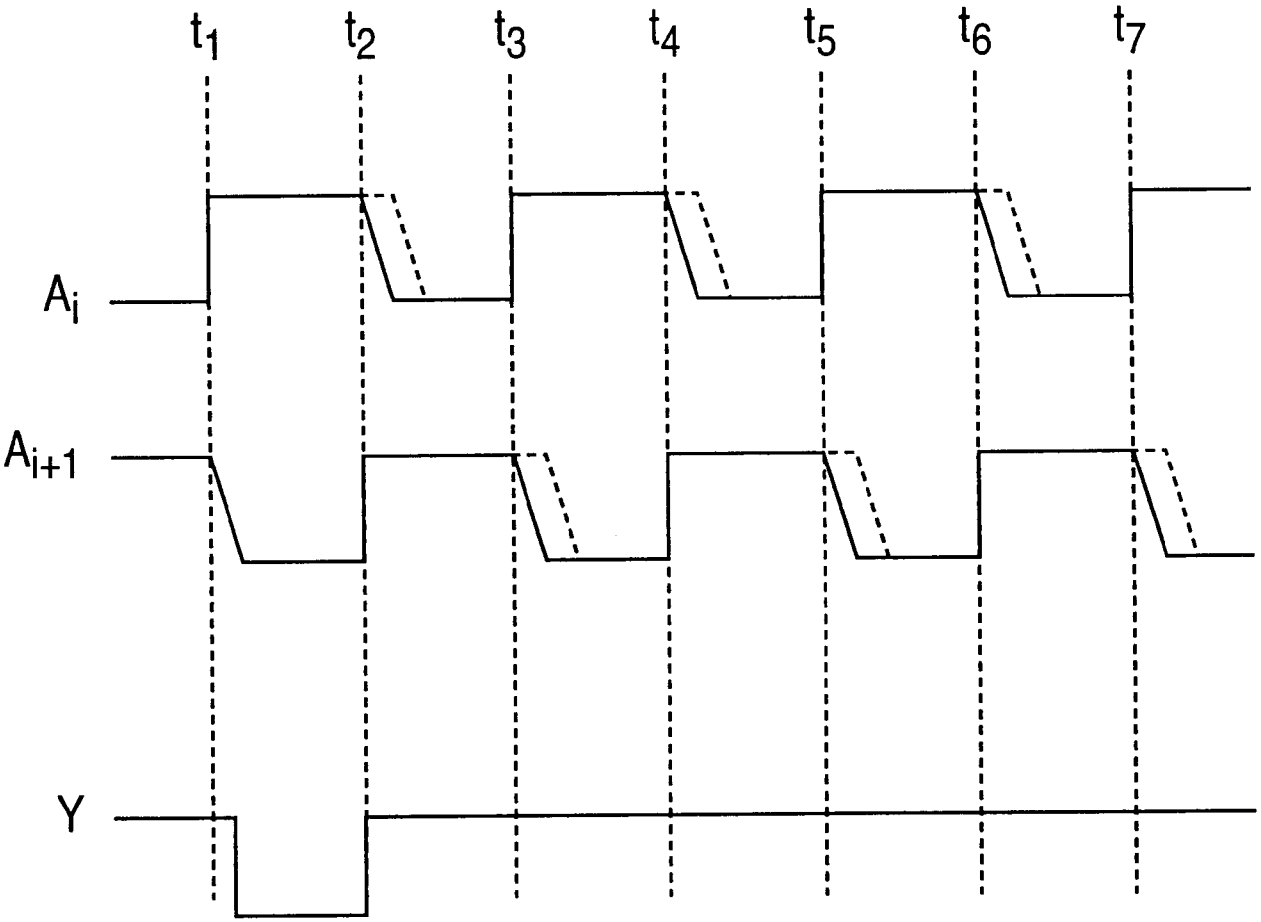
FIG. 23 is a diagram showing the waveforms of other drive pulses applied to address electrodes.

FIGS. 22 and 23 show, by way of example, the waveforms of other drive pulses applied to the adjacent address electrodes. In the waveforms of other drive pulses shown in FIGS. 22 and 23, the drive pulses rise and fall at different gradients.

In FIG. 22, the drive pulses rise gradually and fall sharply. Even if the drive pulses applied to the adjacent address electrodes start to rise and fall at the same time, the principles of the present invention apply when the drive pulses rise and fall at different gradients. The electric power consumption can greatly be reduced if the drive pulses rise gradually and start rising at a delayed time as indicated by the broken lines in FIG. 22.

In FIG. 23, the drive pulses rise sharply and fall gradually. The electric power consumption can greatly be reduced if the drive pulses start falling at a delayed time as indicated by the broken lines in FIG. 23. In the example shown in FIG. 23, the pulse duration of the drive pulse applied to the scanning electrodes is reduced because there are periods in which both the drive pulses for the adjacent address electrodes are of an H level.

It has been stated above with respect to the above waveforms of the drive pulses that the electric power consumption is largely reduced when the drive pulses are applied at differently times or start to rise and fall at different gradients. In the address period, charges generated by plasma discharges are left as wall charges, and sustained discharges are generated when the voltage in the sustained discharge period is added to the voltage caused by the wall charges. Therefore, it is necessary to supply an amount of energy large enough to cause sufficient sustained discharges in the address period. Such no sufficient amount of such energy is available if the period in which both the drive pulses are of an L level is too long. If the period in which both the drive pulses are of an H level is long, then the scanning pulse duration becomes shorter, with the result that the amount of energy for causing sufficient sustained discharges becomes insufficient. According to the present invention, the address driver is designed to reduce the electric power consumption to a maximum degree while keeping those periods in balance.

Figure 24A:
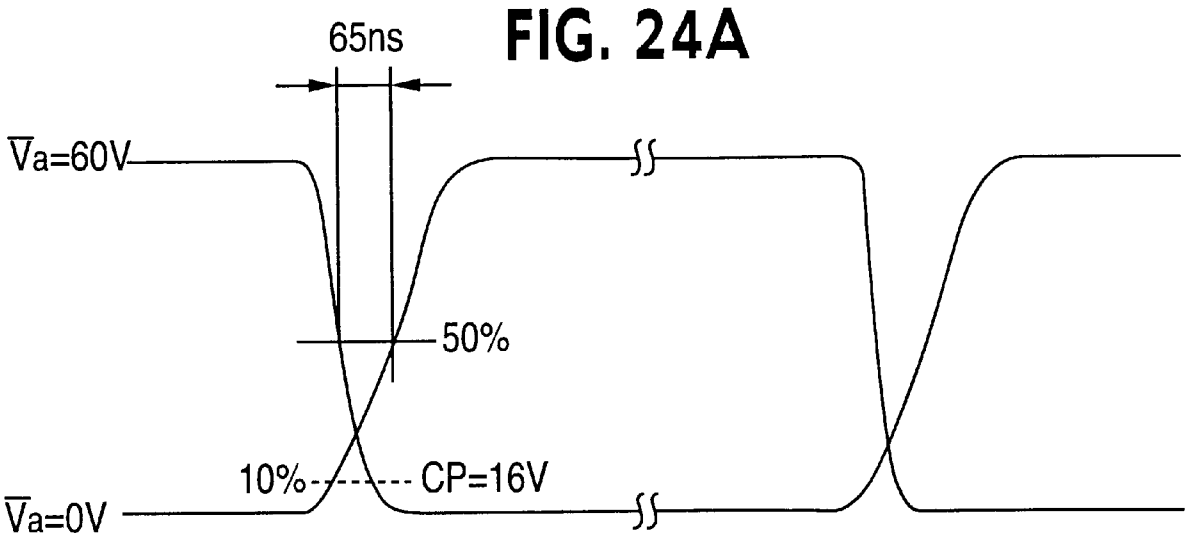
FIGS. 24(*a*) and 24(*b*) are diagrams showing the waveforms of more realistic drive pulses for address electrodes.
Figure 24B:
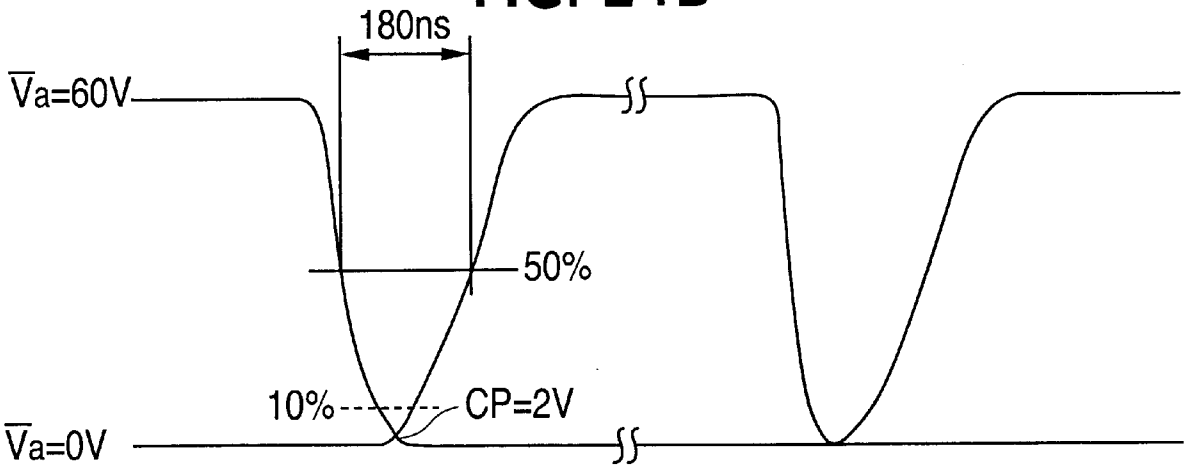

FIGS. 24A and 24B show the waveforms of more realistic drive pulses for the address electrodes. In FIG. 24A, the drive pulses start to rise and fall substantially at the same time. In FIG. 24B, one of the drive pulses starts to rise later than the other drive pulse starts to fall.

In FIG. 24A, the drive pulses rise at a somewhat low gradient. Although usual address drivers need more time for the pull-up transistors to be energized than the pull-down transistors, it is not possible to reduce a sufficient amount of consumed electric power with the low gradient at which the drive pulses rise.

The voltage level of the cross point in FIG. 24A is 16 V which is much higher than 6 V that is 10% of the higher voltage of 60 V. Therefore, any reduction in the electric power consumption is small with the drive pulse waveforms shown in FIG. 24A.

In FIG. 24B, since one of the drive pulses starts to rise later than the other drive pulse starts to fall, the consumed electric power can be reduced by a sufficient amount.

When the drive signals rise and fall, respectively, the delay of one of the drive pulses from the other drive pulse at a voltage level of 50% is about 65 nsec. in FIG. 24A and about 180 nsec. in FIG. 24B. In FIGS. 24A and 24B, the pulse duration is about 3000 nsec. and the delay of 180 nsec. in FIG. 24B is more than 5% of the pulse duration.

The voltage level of the cross point in FIG. 24B is 2 V which is sufficiently smaller than 6 V that is 10% of the higher voltage of 60 V. Therefore, a large reduction in the electric power consumption can be achieved with the drive pulse waveforms shown in FIG. 24B.

Address Driver

Figure 25:
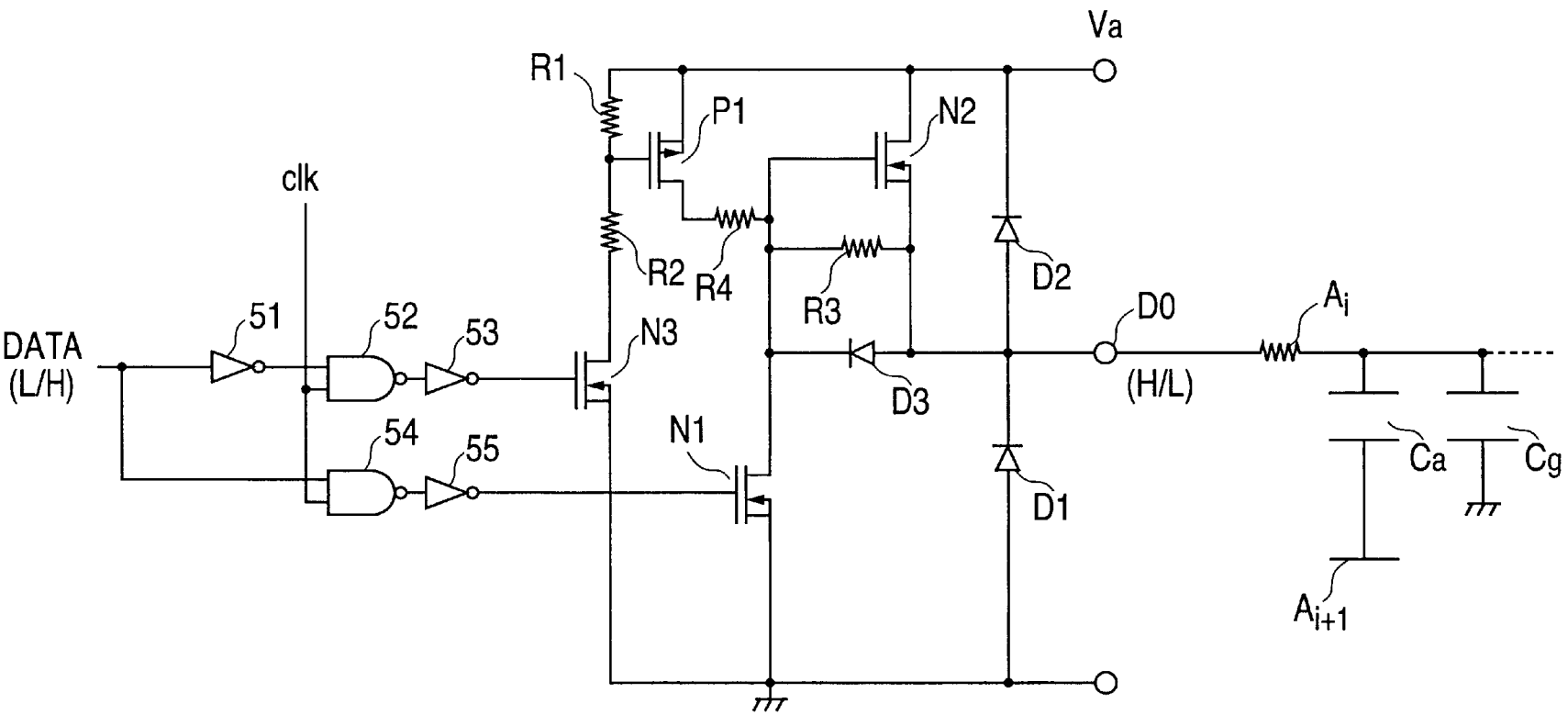
FIG. 25 is a specific circuit diagram of the address driver.

FIG. 25 specifically shows details of the address driver. In FIG. 25, an N-type pull-up transistor N2 and an N-type pull-down transistor N1 are connected to an output terminal DO which is connected to the address electrode $A_i$. A display data signal Data is supplied through a NAND gate 54 and an inverter 55 to the gate of the pull-down transistor N1. When the display data signal Data is of an H level, the gate voltage of the pull-down transistor $N_i$goes high, rendering the pull-down transistor N1 conductive. Therefore, the potential of the address electrode $A_i$ is lowered to the ground potential through a diode D3.

The pull-up transistor N2 has a source connected to the address electrode $A_i$ through the output terminal DO. Therefore, the pull-up transistor N2 needs to remain conductive even when the potential of the source increases to a level close to the potential of the power supply Va. A voltage close to the potential of the power supply Va is applied to the gate of the pull-up transistor N2 through an N-type transistor N3, a P-type transistor P1, and resistors R1~R4. When the display data signal Data is of an L level, the transistor N3 is energized, and a low voltage divided by the resistors R1, R2 is applied the gate of the P-type transistor P1. As a result, the P-type transistor P1 is energized, increasing the gate voltage of the transistor N2 to a level close to the potential of the power supply Va, whereupon the transistor N2 is rendered conductive.

The time at which the pull-up transistor N2 is turned on is later than the time at which the pull-down transistor N1 is turned on because the P-type transistor P1 is inserted. For making the present invention more effective, the inverter 53 may have a function to delay a signal passing therethrough. A timing clock clk may differ between odd-numbered address electrodes and even-numbered address electrodes to shift the drive pulses as shown in FIGS. 20 and 21.

According to the principles of the present invention, the voltage level of the scanning electrodes Y in the address period may not be limited to the ground potential shown in FIG. 4, but may be set to an arbitrary potential such as a negative potential or the like.

As described above, the electric power consumed by the address driver of the PDP can greatly be reduced according to the present invention. Therefore, it is possible to provide a power-saver flat display panel according to the present invention.

Although certain preferred embodiments of the present invention have been shown and described in detail, it should be understood that various changes and modifications may be made therein without departing from the scope of the appended claims.

What is claimed is:

1. A display apparatus, comprising:

a flat display panel having a plurality of address electrodes and a plurality of scanning electrodes extending transversely to said address electrodes and disposed in confronting relation to said address electrodes, said address electrodes including first and second address electrodes disposed adjacent to each other;

a scanning electrode driver successively supplying scanning pulses to said scanning electrodes at each one of scanning periods;

address drivers supplying address pulses according to display data to said address electrodes in synchronism with said scanning periods, said address drivers comprising first and second address drivers connected to the first and second address electrodes, respectively, and when transferring from a scan operation for one scanning electrode to a next scan operation for another scanning electrode, the first address driver energizing the first address electrode such that a rising address pulse starts rising and the second address driver energizing the second address electrode such that a falling address pulse starts falling; and a control circuit controlling the first and second address drivers, with the first and second address drivers starting the rising and falling, respectively, at different predetermined times.

2. The display apparatus according to claim 1, wherein said address drivers energize said address electrodes such that the falling address pulse applied to said second address electrode starts falling a predetermined time after said rising address pulse applied to said first address electrode starts rising.

3. The display apparatus according to claim 2, wherein a voltage at a cross point between said rising address pulse applied to said first address electrode as said rising address pulse rises and said falling address pulse applied to said second address electrode as said falling address pulse falls is at most about 10% of a voltage to which said rising address pulse applied to said first address electrode rises or said falling address pulse applied to said second address electrode falls.

4. The display apparatus according to claim 2, wherein a voltage at a cross point between said rising address pulse applied to said first address electrode as said rising address pulse rises and said falling address pulse applied to said second address electrode as said falling address pulse falls is at least about 90% of a voltage to which said rising address pulse applied to said first address electrode rises or said falling address pulse applied to said second address electrode falls.

5. The display apparatus according to claim 1, wherein said address drivers energize said address electrodes such that the rising address pulse applied to said first address electrode starts rising a predetermined time after said falling address pulse applied to said second address electrode starts falling.

6. The display apparatus according to claim 5, wherein a voltage at a cross point between said rising address pulse applied to said first address electrode as said rising address pulse rises and said falling address pulse applied to said second address electrode as said falling address pulse falls is at most about 10% of a voltage to which said rising address pulse applied to said first address electrode rises or said falling address pulse applied to said second address electrode falls.

7. The display apparatus according to claim 5, wherein a voltage at a cross point between said rising address pulse applied to said first address electrode as said rising address pulse rises and said falling address pulse applied to said second address electrode as said falling address pulse falls is at least about 90% of a voltage to which said rising address pulse applied to said first address electrode rises or said falling address pulse applied to said second address electrode falls.

8. The display apparatus according to claim 1 wherein said address drivers energize said address electrodes such that the falling address pulse applied to said second address electrode starts falling after said rising address pulse applied to said first address electrode finishes rising.

9. The display apparatus according to claim 8, wherein a voltage at a cross point between said rising address pulse applied to said first address electrode as said rising address pulse rises and said falling address pulse applied to said second address electrode as said falling address pulse falls is at most about 10% of a voltage to which said rising address pulse applied to said first address electrode rises or said falling address pulse applied to said second address electrode falls.

10. The display apparatus according to claim 8, wherein a voltage at a cross point between said rising address pulse applied to said first address electrode as said rising address pulse rises and said falling address pulse applied to said second address electrode as said falling address pulse falls is at least about 90% of a voltage to which said rising address pulse applied to said first address electrode rises or said falling address pulse applied to said second address electrode falls.

11. The display apparatus according to claim 1, wherein said address drivers energize said address electrodes such that the rising address pulse applied to said first address electrode starts rising after said falling address pulse applied to said second address electrode finishes falling.

12. The display apparatus according to claim 11, wherein a voltage at a cross point between said rising address pulse applied to said first address electrode as said rising address pulse rises and said falling address pulse applied to said second address electrode as said falling address pulse falls is at most about 10% of a voltage to which said rising address pulse applied to said first address electrode rises or said falling address pulse applied to said second address electrode falls.

13. The display apparatus according to claim 11, wherein a voltage at a cross point between said rising address pulse applied to said first address electrode as said rising address pulse rises and said falling address pulse applied to said second address electrode as said falling address pulse falls is at least about 90% of a voltage to which said rising address pulse applied to said first address electrode rises or said falling address pulse applied to said second address electrode falls.

14. The display apparatus according to claim 1, wherein said address drivers generate a predetermined time difference by energizing said address electrodes such that the address pulses applied to said first address electrode rise at a gradient smaller than a gradient at which the address pulses applied to said second address electrode fall.

15. The display apparatus according to claim 14, wherein a voltage at a cross point between said rising address pulse applied to said first address electrode as said rising address pulse rises and said falling address pulse applied to said second address electrode as said falling address pulse falls is at most about 10% of a voltage to which said rising address pulse applied to said first address electrode rises or said falling address pulse applied to said second address electrode falls.

16. The display apparatus according to claim 14, wherein a voltage at a cross point between said rising address pulse applied to said first address electrode as said rising address pulse rises and said falling address pulse applied to said second address electrode as said falling address pulse falls is at least about 90% of a voltage to which said rising address pulse applied to said first address electrode rises or said falling address pulse applied to said second address electrode falls.

17. The display apparatus according to claim 1, wherein said address drivers generate a predetermined time difference by energizing said address electrodes such that the address pulses applied to said first address electrode rise at a gradient larger than a gradient at which the address pulses applied to said second address electrode fall.

18. The display apparatus according to claim 17, wherein a voltage at a cross point between said rising address pulse applied to said first address electrode as said rising address pulse rises and said falling address pulse applied to said second address electrode as said falling address pulse falls is at most about 10% of a voltage to which said rising address pulse applied to said first address electrode rises or said falling address pulse applied to said second address electrode falls.

19. The display apparatus according to claim 17, wherein a voltage at a cross point between said rising address pulse applied to said first address electrode as said rising address pulse rises and said falling address pulse applied to said second address electrode as said falling address pulse falls is at least about 90% of a voltage to which said rising address pulse applied to said first address electrode rises or said falling address pulse applied to said second address electrode falls.

20. The display apparatus according to claim 1, wherein each of said address drivers has a pull-up transistor and a pull-down transistor which are connected to said address electrodes, and said pull-up transistor and said pull-down transistor are energized at respective times which respective times have a predetermined time difference therebetween.

21. The display apparatus according to claim 20, wherein said pull-up transistor is energized later than said pull-down transistor.

22. The display apparatus according to claim 20, wherein said pull-up transistor is energized earlier than said pull-down transistor.

23. A PDP display apparatus, comprising:

a flat display panel having a plurality of address electrodes and a plurality of scanning electrodes extending transversely to said address electrodes and disposed in confronting relation to said address electrodes, said address electrodes including first and second address electrodes disposed adjacent to each other;

a scanning electrode driver successively supplying scanning pulses to said scanning electrodes at each one of scanning periods;

address drivers supplying address pulses according to display data to said address electrodes in synchronism with said scanning periods, said address drivers comprising first and second address drivers connected to the first and second address electrodes, respectively, and when transferring from a scan operation for one scanning electrode to a next scan operation for another scanning electrode, the first address driver energizing the first address electrode such that a rising address pulse starts rising and the second address driver energizing the second address electrode such that a falling address pulse starts falling; and a control circuit controlling the first and second address drivers, with the first and second address drivers starting the rising and falling, respectively, at different predetermined times.

24. The display apparatus according to claim 1, wherein a voltage at a cross point between said rising address pulse applied to said first address electrode as said rising address pulse rises and said falling address pulse applied to said second address electrode as said falling address pulse falls is at most about 10% of a voltage to which said rising address pulse applied to said first address electrode rises or said falling address pulse applied to said second address electrode falls.

25. The display apparatus according to claim 1, wherein a voltage at a cross point between said rising address pulse applied to said first address electrode as said rising address pulse rises and said falling address pulse applied to said second address electrode as said falling address pulse falls is at least about 90% of a voltage to which said rising address pulse applied to said first address electrode rises or said falling address pulse applied to said second address electrode falls.

26. A display apparatus, comprising:

a flat display panel having a plurality of address electrodes and a plurality of scanning electrodes extending transversely to said address electrodes and disposed in confronting relation to said address electrodes, said address electrodes including first and second address electrodes disposed adjacent to each other;

a scanning electrode driver successively supplying scanning pulses to said scanning electrodes respectively; and address drivers supplying address pulses according to display data to said address electrodes in synchronism with each of said scanning pulses, said address drivers comprising first and second address drivers connected to the first and second address electrodes, respectively, wherein during successive scanning operations to scanning electrodes, a rising edge of the address pulse to the first address electrode starts rising and a falling edge of the address pulse to the second address electrode starts falling, at different predetermined times.

27. A display apparatus, comprising:

a flat display panel having a plurality of address electrodes and a plurality of scanning electrodes extending transversely to said address electrodes and disposed in confronting relation to said address electrodes, said address electrodes including first and second address electrodes disposed adjacent to each other;

a scanning electrode driver successively supplying scanning pulses to said scanning electrodes at each one of scanning periods;

address drivers supplying address pulses according to display data to said address electrodes in synchronism with said scanning periods, said address drivers comprising first and second address drivers connected to the first and second address electrodes, respectively, and during one of the scanning periods, the first address driver applying a rising address pulse to the first address electrode and the second address driver applying a falling address pulse to the second address electrode; and a control circuit controlling the first and second address drivers, with the first and second address drivers applying the rising and falling address pulses, respectively, at different predetermined times.

28. A PDP display apparatus, comprising:

a flat display panel having a plurality of address electrodes and a plurality of scanning electrodes extending transversely to said address electrodes and disposed in confronting relation to said address electrodes, said address electrodes including first and second address electrodes disposed adjacent to each other;

a scanning electrode driver successively supplying scanning pulses to said scanning electrodes at each one of scanning periods;

address drivers supplying address pulses according to display data to said address electrodes in synchronism with said scanning periods, said address drivers comprising first and second address drivers connected to the first and second address electrodes respectively, and during one of the scanning periods, the first address driver applying a rising address pulse to the first address electrode and the second address driver applying a falling address pulse to the second address electrode; and a control circuit controlling the first and second address drivers, with the first and second address drivers applying the rising and falling address pulses, respectively, at different predetermined times.

* * * * *